US005945924A

United States Patent [19]

Marman et al.

[11] Patent Number: 5,945,924

[45] Date of Patent: Aug. 31, 1999

[54] FIRE AND SMOKE DETECTION AND CONTROL SYSTEM

[76] Inventors: Douglas H. Marman, 3004 NE 160th Street, Ridgefield, Wash. 98642; Mark A. Peltier, 560 West Division, Sherwood, Oreg. 97140; Jacob Y. Wong, 7110 Georgetown Rd., Goleta, Calif. 93117

[21] Appl. No.: 08/901,723

[22] Filed: Jul. 28, 1997

Related U.S. Application Data

[63] Continuation-in-part of application No. 08/757,194, Nov. 27, 1996, abandoned, which is a continuation-in-part of application No. 08/593,253, Jan. 29, 1996, Pat. No. 5,767,776, and application No. 08/593,750, Jan. 29, 1996, Pat. No. 5,691,704.

[51] Int. Cl.[6] ..... G08B 17/10

[52] U.S. Cl. ..... 340/928; 340/930; 340/932

[58] Field of Search ..... 340/628, 630, 340/632, 522, 578, 521

[56] References Cited

U.S. PATENT DOCUMENTS

| | | | |
|---|---|---|---|
| 4,103,997 | 8/1978 | Araki et al. | 340/630 |
| 4,916,432 | 4/1990 | Tice et al. | 340/518 |
| 5,189,394 | 2/1993 | Walter et al. | 340/525 |
| 5,260,687 | 11/1993 | Yamauchi et al. | 340/588 |
| 5,261,596 | 11/1993 | Tachibana et al. | 236/49.3 |
| 5,280,272 | 1/1994 | Nagashima et al. | 340/630 |
| 5,394,934 | 3/1995 | Rein et al. | 236/49.3 |
| 5,523,743 | 6/1996 | Rattman et al. | 340/630 |
| 5,673,027 | 9/1997 | Morita | 340/628 |
| 5,691,703 | 11/1997 | Roby et al. | 340/630 |

*Primary Examiner*—Jeffery A. Hofsass
*Assistant Examiner*—Van T. Trieu
*Attorney, Agent, or Firm*—Stoles Rives LLP

[57] ABSTRACT

A fire detection system combines a $CO_2$ gas detector with a smoke detector. Logic circuitry combines the outputs of both detectors to minimize false alarms and provide a rapid response time. In a preferred embodiment the need for periodic cleaning is reduced. In a further preferred embodiment, two alarms indicative of two different types of fires, for example flaming fires and nonflaming fires are available. A map of flaming fire and smoke may be assembled by the system to guide the firefighters. In a yet another preferred embodiment, a tentative fire alarm indication disables a local air conditioning system thereby helping to isolate and control any existing fire.

34 Claims, 13 Drawing Sheets

SMOKE DETECTOR
300
SMOKE DETECTOR OUTPUT
310
$CO_2$ DETECTOR
200
$CO_2$ DETECTOR OUTPUT
210
> FIRST THRESHOLD ?
$A_1$
YES
$t > T_1$ ?
$A_2$
YES
SMOLDERING FIRE
> FIRST THRESHOLD ?
$B_1$
YES
$t > T_2$ ?
$B_2$
YES
$C_2$
$C_4$
ALARM SIGNAL
51
ALARM
500
SLOPE FIRST RATE ?
$C_1$
YES
$t > T_3$ ?
$C_5$
SLOPE SECOND RATE ?
$C_3$
YES
$t > T_4$ ?
$C_6$
FAST MOVING FIRE
ALARM LOGIC 400
FIRE DETECTOR 100

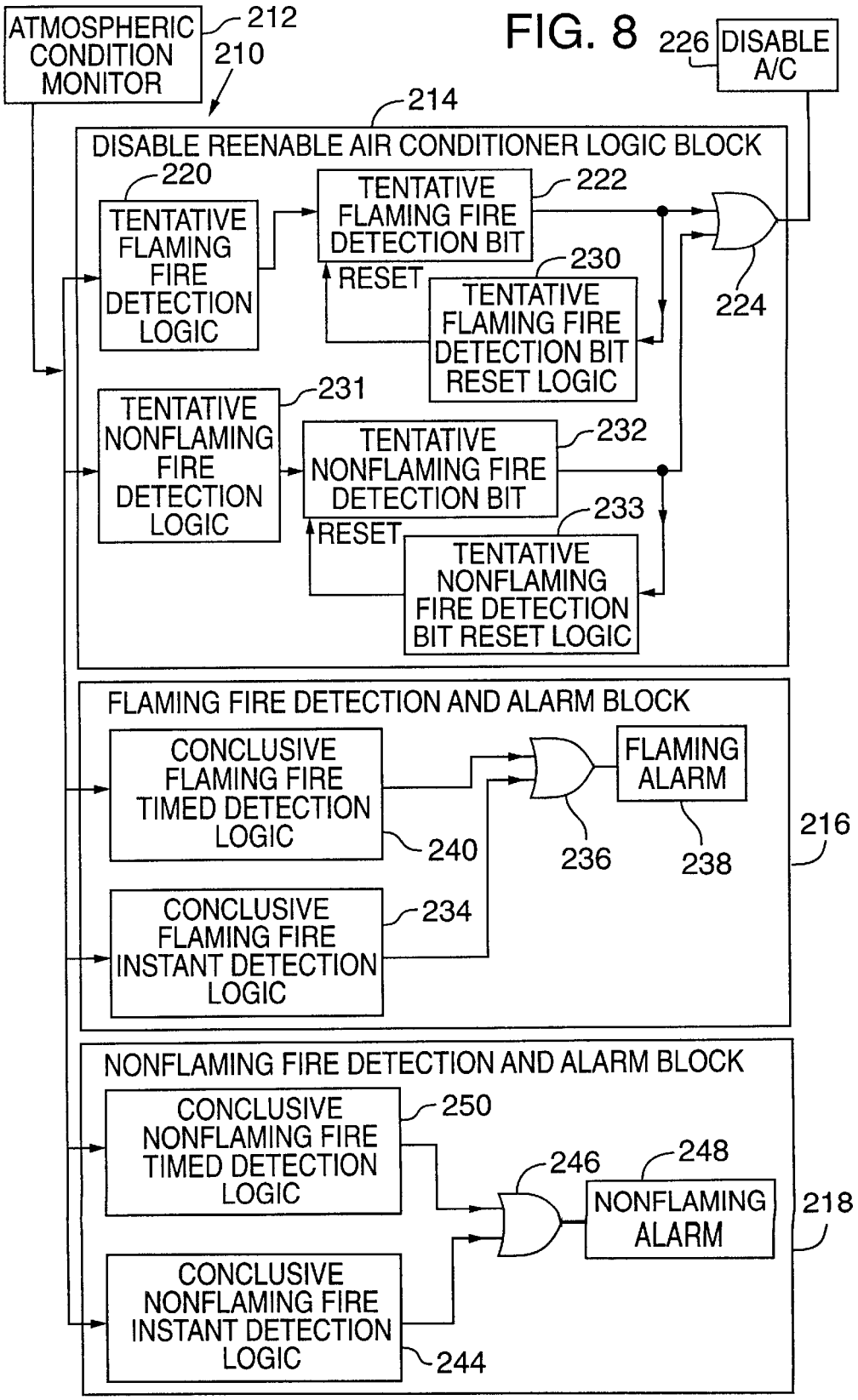
FIG. 8
ATMOSPHERIC CONDITION MONITOR
212
210
226
DISABLE A/C
214
DISABLE REENABLE AIR CONDITIONER LOGIC BLOCK
220
TENTATIVE FLAMING FIRE DETECTION LOGIC
TENTATIVE FLAMING FIRE DETECTION BIT
222
RESET
230
TENTATIVE FLAMING FIRE DETECTION BIT RESET LOGIC
224
231
TENTATIVE NONFLAMING FIRE DETECTION LOGIC
TENTATIVE NONFLAMING FIRE DETECTION BIT
232
RESET
233
TENTATIVE NONFLAMING FIRE DETECTION BIT RESET LOGIC
FLAMING FIRE DETECTION AND ALARM BLOCK
CONCLUSIVE FLAMING FIRE TIMED DETECTION LOGIC
240
236
FLAMING ALARM
238
216
CONCLUSIVE FLAMING FIRE INSTANT DETECTION LOGIC
234
NONFLAMING FIRE DETECTION AND ALARM BLOCK
CONCLUSIVE NONFLAMING FIRE TIMED DETECTION LOGIC
250
246
248
NONFLAMING ALARM
218
CONCLUSIVE NONFLAMING FIRE INSTANT DETECTION LOGIC
244

FIRE AND SMOKE DETECTION AND CONTROL SYSTEM

RELATED PATENT APPLICATION

This is a continuation-in-part of application Ser. No. 08/757,194 abandoned, filed Nov. 27, 1996, which is a continuation-in-part of application Ser. No. 08/593,253 U.S. Pat. No. 5,767,776 and of application Ser. No. 08/593,750 U.S. Pat. No. 5,691,704, both of which were filed Jan. 29, 1996.

TECHNICAL FIELD

The present invention is in the field of fire and smoke detection and control systems.

BACKGROUND OF THE INVENTION

Since 1975, the United States experienced remarkable growth in the usage of home smoke detectors, principally single-station, battery-operated, ionization-mode smoke detectors. This rapid growth, coupled with clear evidence in actual fires and fire statistics of the lifesaving effectiveness of detectors, made the home smoke detector the fire safety success story of the past two decades.

In recent years, however, studies of the operational status of smoke detectors in homes revealed an alarming statistic that as many as one-fourth to one-third of smoke detectors are nonoperational at any one time. Over half of the nonoperational smoke detectors are attributable to missing batteries. The rest is due to dead batteries and nonworking smoke detectors. Research showed the principal cause of the missing batteries was homeowner's frustration over nuisance alarms, which are caused not by hostile, unwanted fires but by controlled fires, such as cooking flames. These nuisance or false alarms are also caused by nonfire sources, such as moisture emanating from a bathroom after someone has taken a shower, dust or debris stirred up during cleaning, or oil vapors escaping from the kitchen.

Centralized fire detection systems also play an important role in protecting the occupants of commercial and industrial buildings. False alarms are detrimental in this setting as well, not only causing inconvenience to building occupants but also creating a dangerous lack of confidence in the validity of future alarms.

The reason the majority of smoke detectors, which are of the ionization type, are prone to these types of nuisance alarms is that they are very sensitive to visible and invisible diffused particulate matter, especially when the fire alarm threshold is set very low to meet the mandated response time for ANSI/UL 268 certification for various types of fires. Visible particulate matter ranges in size from 4 to 5 microns in a minimum dimension (although small particles can be seen as a haze when present in high mass density) and is generated copiously in most open fires or flames. However, ionization detectors are most sensitive to invisible particles ranging from 1.0 to 0.01 micron in a minimum dimension. Most household nonfire sources, as discussed briefly above, generate mostly invisible particulate matters. This explains why most home smoke detectors encounter so many nuisance alarms.

The problem of frequent false alarms, caused by ionization smoke detectors and resulting in a significant portion of them at any one time being functionally nonoperational, led to the increased use in recent years of another type of smoke detector, namely the photoelectric smoke detector. Photoelectric smoke detectors work best for visible particulate matter and are relatively insensitive to invisible particulate matter. They are therefore less prone to nuisance alarms. However, the drawback is that they are slow in responding to flaming fires in which the early particulate matter generated is mostly invisible. To overcome this drawback, the fire alarm threshold of photoelectric smoke detectors has to be set very low or at high sensitivity to meet the ANSI/UL 268 certification requirements. Such low fire alarm thresholds for the photoelectric smoke detectors also lead to frequent false alarms. Thus the problem of nuisance false alarms for smoke detectors comes full circle. It is apparent that over the years the problem has been long recognized but has not been solved. It is equally apparent that a new type of fire detector is urgently needed to resolve the dangerous ineffectiveness of present-day smoke detectors.

Another aspect of present-day smoke detectors that is often discussed but seldom addressed is the slow fire response of these detectors. The current ANSI/UL 268 fire detector certification code was developed and dictated years ago by the fire detection technology, viz., the technology of smoke detectors. Opinion of workers in the fire fighting and prevention industry over the past two decades has always been critical of the speed of response of the available smoke detectors. Obviously, increasing their sensitivity through the lowering of the light obscuration detection threshold of the smoke detectors will speed up their response. However, lowering the detection threshold also drives up the nuisance alarm rates. Looking from this perspective, it is also apparent that a better fire detector is urgently needed.

Taking advantage of the copious production of $CO_2$ gas by virtually all manner of fires, a new type of fire detector keying on the detection of $CO_2$ gas was disclosed by Jacob Y. Wong, one of the present inventors, in U.S. Pat. No. 5,053,754. This new fire detector responds more rapidly to fires than the widely used smoke detectors. It senses increases in the concentration of $CO_2$ associated with a fire by measuring the concomitant increase in the absorption of a beam of radiation whose wavelength is located at a strong absorption band of $CO_2$. The disclosed device is considerably simplified by the use of a sample chamber window that is highly permeable to $CO_2$ but which keeps out particles of dust, smoke, oil, and water.

In subsequent U.S. Pat. Nos. 5,079,422; 5,103,096; and 5,369,397, inventor Wong continued to disclose a number of improved methods of using single or multiple $CO_2$ detectors to detect fires. The superiority of using $CO_2$ detectors as fire detectors over smoke detectors in terms of speed of response and immunity against common nuisance alarms has been well established. In co-pending patent application No. 08/077,488, filed Nov. 14, 1994, for FALSE ALARM RESISTANT FIRE DETECTOR WITH IMPROVED PERFORMANCE and U.S. patent application Ser. No. 08/593,253, filed Jan. 30, 1996, for AN IMPROVED FIRE DETECTOR, inventor Wong further disclosed the advantage of combining a $CO_2$ detector with a smoke detector to form a fast and false alarm-resistant fire detector.

Even though advantages of using $CO_2$ detectors as fire detectors have been proposed, the reality is that until such time as the manufacturing cost of a nondispersive infrared ("NDIR") $CO_2$ detector is reduced to an economically attractive level, the consumer will be unwilling to purchase this new and improved fire detector because of hard-nosed economics. The concomitant effort to simplify and reduce the cost of an NDIR $CO_2$ detector is therefore equally important and relevant in forging the advent of the currently disclosed practical and improved fire detector.

In U.S. Pat. No. 5,026,992, inventor Wong disclosed a novel simplification of an NDIR gas detector with the ultimate goal of reducing the cost of this device to the point that it can be used to detect $CO_2$ gas in its application as a new fire detector as discussed above. U.S. Pat. No. 5,026,992 disclosed a spectral ratio forming technique for NDIR gas analysis using a differential temperature source that leads to an extremely simple NDIR gas detector comprising only one infrared source and one infrared detector. In U.S. Pat. No. 5,163,332, inventor Wong disclosed the use of a diffusion-type gas sample chamber in the construction of an NDIR gas detector that eliminated virtually all the delicate and expensive optical and mechanical components of a conventional NDIR gas detector. In U.S. Pat. No. 5,341,214, inventor Wong expanded the novel idea of a diffusion-type sample chamber of U.S. Pat. No. 5,163,332 to include the conventional spectral ratio forming technique in NDIR gas analysis. In U.S. Pat. No. 5,340,986, inventor Wong extended the disclosure of a diffusion-type gas chamber in U.S. Pat. No. 5,163,332 to a "re-entrant" configuration, thus simplifying even further the construct of an NDIR gas detector. Still further simplification is required if $CO_2$ sensors are to gain acceptance in low-cost household fire detectors and thus fulfill the long-felt need for an improved fire detector with a lower response time that still minimizes false alarms.

There are also problems caused by the fact that modern buildings, such as office buildings, typically include both a fire control system and an air conditioning system. The fire control system typically includes numerous fire detectors that measure a condition, such as smoke density, at locations throughout the building. In the event a fire is detected, an alarm is typically sounded. Unfortunately, the air conditioning system frequently works to both prevent detection of a fire and to facilitate the growth of a fire. This happens when the air-conditioning system blows air into the area, diluting the concentration of smoke and fire by-product gasses and thereby delaying or preventing detection. This air also supplies new oxygen to the fire, facilitating its growth.

Alarm systems also typically issue a single type alarm signal only. There are, however, many types of fires with different levels of urgency. Although it might seem desirable to meet every fire alarm with the full capability of the local fire department, this would make the local fire department frequently unprepared for other fires. In the worst situation several fire trucks would respond to an alarm from a very slow burning fire and then be unable to reach a rapidly burning fire in a timely manner.

Heretofore, firefighters reaching a burning building entered the building with only scant information concerning the location of the flames and smoke. This placed the firefighters in considerable peril as they entered and explored the building, searching for flames while attempting to avoid thick smoke. Unexpectedly encountered flames and thick smoke have caused the death of many fire fighters.

There exist fire detection systems that are adapted for placement in air conditioning ducts. When a fire is detected, typically through the detection of smoke, this type of fire detector causes the air conditioning vent to shut, thereby helping to isolate the fire. This type of detector cannot, however, distinguish between a fire present within the vent or a fire in the building outside of the vent. This lack of information hinders detection of the fire.

In addition, heretofore available systems did not close the vent or vents until a fire indicating criterion was satisfied. The air conditioning system might already have been operating for a while at that point, both feeding the fire with oxygen and delaying the detection of the fire.

Yet another aspect of present day smoke detector systems is the expensive requirement for periodic maintenance. Atmospheric dust gradually accumulates on light emitting and receiving surfaces inside the smoke detectors, degrading their performance. Some smoke detectors can signal when the dust accumulation has degraded performance below a minimum acceptable level. These must be cleaned when indicated by the signal. Others must be cleaned according to a schedule designed to maintain performance above the minimum acceptable level.

In either case, the task of cleaning is nontrivial. Typically, the smoke detector must be removed from its location and replaced with a similar unit. The actual cleaning is performed at a separate location and involves a fair degree of labor and partial disassembly of the unit. Therefore a detector that reduces or eliminates the need for cleaning is highly desirable.

SUMMARY OF THE INVENTION

The present invention is generally directed to a practical and improved fire and smoke detection system having a faster response time that detects fires, including smoldering (i.e. nonflaming) and flaming fires, while still minimizing false alarms through the combination of a smoke detector and a $CO_2$ detector. In particular, the present invention relates to the utility of novel design configurations (both mechanical and electrical) for implementing the combination of a smoke detector and a $CO_2$ gas detector as part of an improved fire detection and control system.

In one aspect of the present invention, information from a smoke detector is analyzed in conjunction with information from a $CO_2$ detector to achieve rapid fire detection without exceeding a specified false alarm rate. Many different criteria may be used to test for the presence of a fire, including criteria with timed thresholds and criteria that examine either the rate of change of $CO_2$ concentration or smoke concentration, or both of them.

Another aspect of the present invention is a method and an apparatus for the detection and control of fires that is useful in a building that has an air conditioning system. The method includes providing a fire detection system that issues a tentative alarm signal in response to any predetermined criterion designated as indicating that a fire exists. This detector is in communicative contact with the air conditioning system, and when the tentative alarm signal is issued, the air conditioning system is disabled. This averts the problem posed by activation of the air conditioner, which activation prevents the detection of and feeds oxygen to the fire.

In a preferred embodiment, the fire detection system also issues a conclusive alarm signal when any predetermined criterion indicates that a fire exists.

Accordingly, it is an object of the present invention to provide a low-cost, practical and improved fire and smoke detection and control system with a reduced maximum response time and minimum number of false alarms.

It is an advantage that the present invention provides a method and an apparatus for preventing the air conditioning system of a building from hindering the detection of fires and from facilitating the growth of a fire.

It is another advantage that the present invention provides an apparatus for disclosing to a user that a fire of a particular type has been detected.

It is a further advantage that the present invention provides a fire detection system that requires greatly reduced or no periodic cleaning.

This object and these advantages as well as additional objects and advantages will be apparent to those skilled in the art by the drawings and the detailed description of preferred embodiments set forth below.

BRIEF DESCRIPTION OF THE DRAWINGS

FIG. 8 is a block logic diagram of a sixth alternative preferred embodiment of the invention;

DETAILED DESCRIPTION OF PREFERRED EMBODIMENTS

Figure 1:
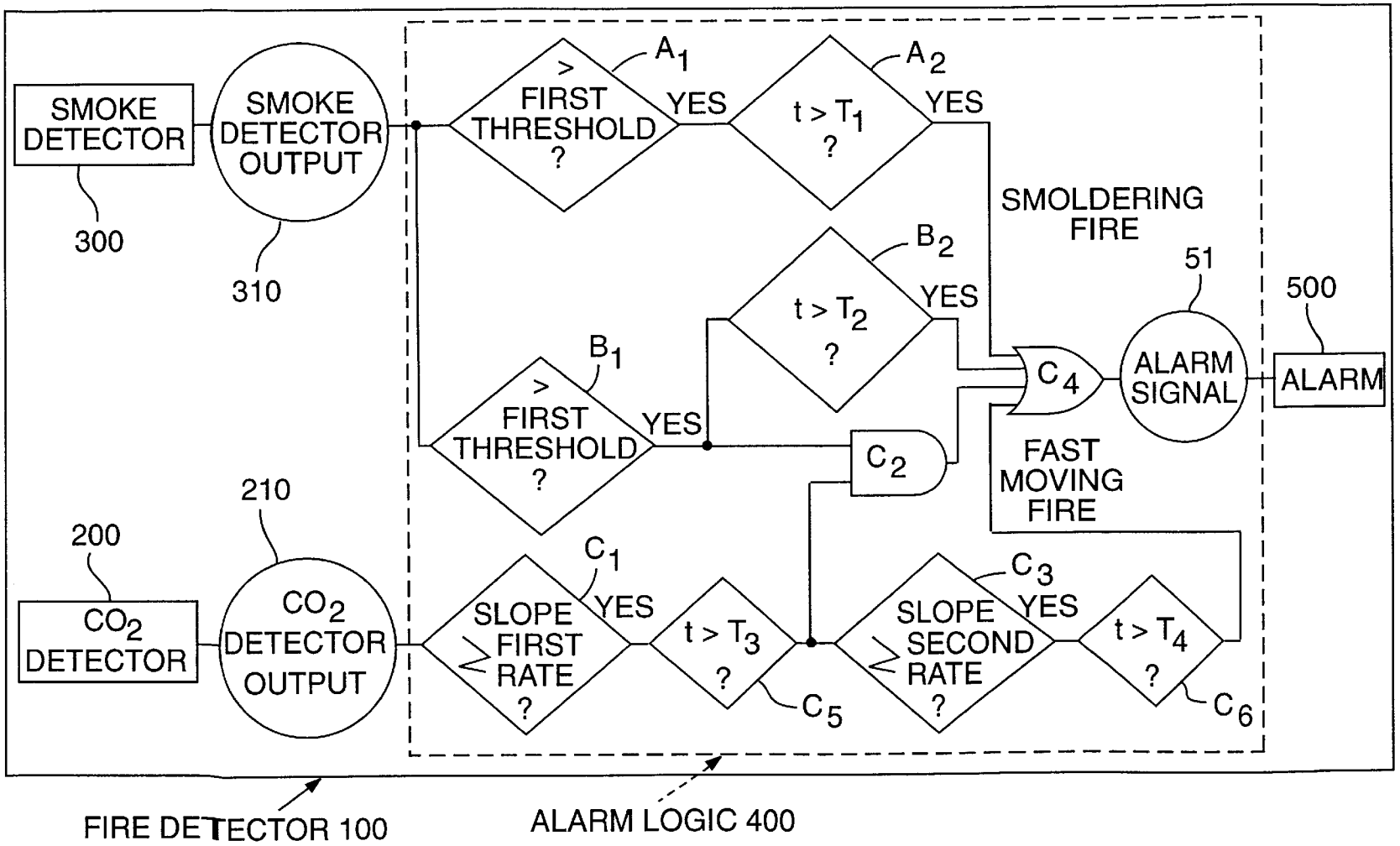
FIG. 1 is a logic diagram for a signal processor used in a preferred embodiment of the present invention.

FIG. 1 is a logic diagram of an embodiment of a practical and improved fire detection system 100. As illustrated in FIG. 1, fire detection system 100 generates an alarm signal 51 when any of four conditions is met. First, an alarm signal 51 will be generated if an output 310 of a smoke detector 300 exceeds a threshold level $A_1$ of 3% light obscuration per 0.3048 meter (1 foot) for greater than a first preselected time $A_2$ of two minutes. Smoke concentration is typically measured in units of "percent light obscuration per 0.3048 meter (1 foot)." This terminology is derived from the use of projected beam or extinguishment photoelectric smoke detectors in which a beam of light is projected through air and the attenuation of the light beam by particles is measured. Even when referring to the measurements of a device that uses another mechanism for measuring smoke concentration, such as light reflection or ion flow sampling, the smoke concentration measurement is frequently specified in terms of percent light obscuration per 0.3048 meter (1 foot) because these units are familiar to skilled persons.

Second, an alarm signal 51 will be generated if output 310 from smoke detector 300 exceeds a reduced threshold level $B_1$ of 1% light obscuration per 0.3048 meter (1 foot) for greater than a second preselected time $B_2$ of 5 to 15 minutes. Third, an alarm signal 51 will be generated if the rate of increase in the measured concentration of $CO_2$ at an output 210 of a $CO_2$ detector 200 exceeds a first predetermined rate $C_1$ of 150 ppm/min for predetermined time period $C_5$ of fewer than 30 seconds and light obscuration exceeds the reduced threshold $B_1$. The output of an AND gate $C_2$ indicates the satisfaction of this condition. Fourth, an alarm signal 51 will be generated if the rate of increase in the measured concentration of $CO_2$ exceeds a second predetermined rate $C_3$ of 700 to 1000 ppm/min for predetermined time period $C_6$ of fewer than 30 seconds. These four conditions are combined by an OR gate $C_4$, the output of which produces an alarm signal 51 that in turn activates an alarm device 500.

Figure 2A:
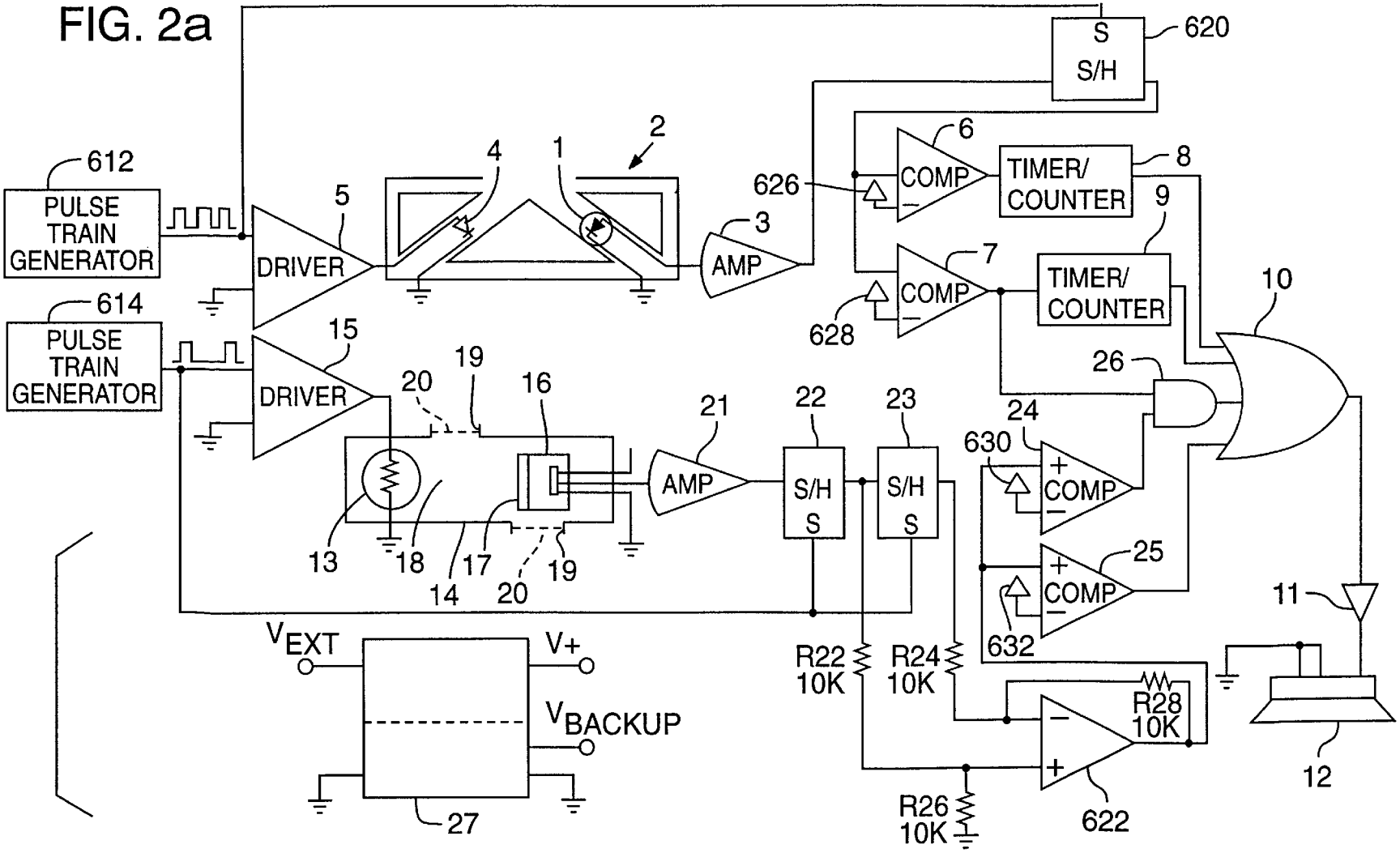
FIG. 2*a* is a schematic layout of the preferred embodiment of FIG. 1 showing a combination of a photoelectric smoke detector and an NDIR $CO_2$ gas detector and their respective signal processing circuit elements and functional relationships.

The logic elements of fire detection system 100 are preferably implemented by the schematic layout shown in FIG. 2*a*.

In the preferred embodiment shown in FIG. 2*a*, a silicon photodiode 1 of a photoelectric smoke detector 2 drives a transimpedance amplifier 3, which has a gain of $-14\times10^6$. An LED 4 of photoelectric smoke detector 2 is pulsed on and off by a driver 5, which in turn is driven by a pulse train generator 612 that emits a pulse stream having a frequency of typically 0.1 Hz and a pulse width of about 300 $\mu$sec, thereby causing LED 4 to emit a corresponding pulsed light signal. LED 4 is termed to be "pulsed on" when it is emitting light and "pulsed off" when it is not.

Photoelectric detector 2 is preferably a light reflection smoke detector, in which photodiode 1 is not located in a straight line path of light travel from LED 4. Consequently, light propagating from LED 4 reaches photodiode 1 only if smoke reflects the light in the direction of photodiode 1. Under normal operating conditions, i.e., in the absence of a fire, the output of photodiode 1 is near a constant zero ampere electrical current because very little light is scattered into it from LED 4. During a fire in which smoke is present in the space between LED 4 and photodiode 1, a pulse stream output signal whose magnitude depends upon the smoke density appears at the output of transimpedance amplifier 3.

The schematic layout of FIG. 2*a* includes comparators 6, 7, 24, and 25; timer counters 8 and 9; an AND gate 26; and an OR gate 10, each of which having a discrete logic output signal. This type of signal will assume one of two distinct voltage levels in dependence on the input signal applied to the component. The higher of the two voltage levels is generally termed a "high" output, and the lower of the two voltage levels is termed a "low" output.

A sample and hold circuit 620 is commanded to sample the output of transimpedance amplifier 3 every pulse train cycle by the output of pulse train generator 612. The output of sample and hold circuit 620 is fed into a high threshold comparator 6 and a low threshold comparator 7. A reference voltage 626 applied to the inverting input of high threshold comparator 6 corresponds to a signal strength of scattered light at photodiode 1 that indicates a level of smoke concentration sufficient to cause approximately 3% light obscuration per 0.3048 meter (1 foot) of the light emitted by LED 4. Thus, when the smoke concentration at detector 2 exceeds this level, the output of high threshold comparator 6 will be high. Similarly, a reference voltage 628 applied to the inverting input of low threshold comparator 7 corresponds to a signal strength of scattered light at photodiode 1 that indicates a level of smoke concentration sufficient to cause 1% light obscuration per 0.3048 meter (1 foot) of the light emitted by LED 4. Thus, when the smoke concentration at detector 2 exceeds this level, the output of low threshold comparator 7 will be high.

The outputs of comparators 6 and 7 are connected to the respective timer counters 8 and 9. For the relatively rapid detection of relatively high smoke density nonflaming fires, timer counter 8 is set to send its output high if the output of high threshold comparator 6 stays high for longer than two minutes. For the relatively slow detection of relatively low smoke density nonflaming fires, timer counter 9 is set to send its output high if the output of low threshold comparator 7 stays high for longer than 15 minutes. Timer counters 8 and 9 will be activated only when the output logic states of the respective comparators 6 and 7 are high. The outputs of timer counters 8 and 9 constitute two of the four inputs to OR gate 10. The output of OR gate 10 goes high to indicate detection of a fire. This signal is boosted by an amplifier 11 and is used to sound an auditory alarm 12.

An infrared source 13 of an NDIR $CO_2$ gas detector 14 is pulsed by a current driver 15, which is driven by a pulse train generator 614 at the rate of about 0.1 Hz to minimize electrical current consumption. The pulsed infrared light radiates through a thin film, narrow bandpass optical filter 17 and onto an infrared detector 16. Optical filter 17 has a center wavelength of about 4.26 microns and a full width at half maximum (FWHM) band width of approximately 0.2 micron. $CO_2$ gas has a very strong infrared absorption band spectrally located at 4.26 microns. The quantity of 4.26 micron light reaching infrared detector 16 depends upon the concentration of $CO_2$ gas present between infrared source 13 and infrared detector 16.

Infrared detector 16 is a single-channel, micro-machined silicon thermopile with an optional built-in temperature sensor in intimate thermal contact with the reference junction. Infrared detector 16 could alternatively be a pyroelectric sensor. In an additional alternative, the general function of infrared detector 16 could be performed by other types of detectors, including metal oxide semiconductor sensors such as a "Taguchi" sensor and photochemical (e.g. colorometric) sensors, but, as skilled persons will appreciate, the supporting circuitry would have to be fairly different. NDIR $CO_2$ detector 14 has a sample chamber 18 with small openings 19 on opposite sides that enable ambient air to diffluse naturally through the sample chamber area between infrared source 13 and infrared detector 16. Small openings 19 are covered with a fiberglass-supported silicon membrane 20 to transmit $CO_2$ and other gasses but prevent dust and moisture-laden particulate matter from entering sample chamber 18. This type of membrane and its use are described more thoroughly in U.S. Pat. No. 5,053,754 for SIMPLE FIRE DETECTOR, which is assigned to one of the assignees of the present application.

The output of the infrared detector 16, which is an electrical pulse stream, is first amplified by an amplifier 21, with a gain of $25\times10^3$. A second sample and hold circuit 22 is commanded every pulse cycle by pulse train generator 614 to sample the resultant pulse stream. Likewise, for every pulse cycle, the output of sample and hold circuit 22 is sampled by a third sample and hold circuit 23.

An operational amplifier 622, configured as a unity gain differential amplifier, subtracts the output of second sample and hold circuit 23, which represents the sample immediately preceding the latest sample, from the output of third sample and hold circuit 22, which represents the latest sample. Amplifier 622 is set to unity gain by the values of resistors R22, R24, R26, and R28. The resultant quantity appearing at the output of amplifier 622 is applied to an input of each of a pair of comparators 24 and 25 having different threshold reference voltages.

Comparator 24 is a low rate of rise comparator having a reference voltage 630 that corresponds to a rate of change of $CO_2$ concentration of approximately 150 ppm/min. When this rate of change for $CO_2$ is exceeded, the output of comparator 24, which is connected to the second input of AND gate 26, will go high. Because the output of low threshold comparator 7 is connected to the other input of AND gate 26, the output of AND gate 26 goes high when there is a smoke concentration sufficient to cause light obscuration of 1% per 0.3048 meter (1 foot) and when $CO_2$ concentration is rising by at least 150 ppm/min.

Comparator 25 is the high rate of rise comparator having a reference voltage 632 that corresponds to a rate of change of $CO_2$ concentration of approximately 1,000 ppm/min. When this rate of change for $CO_2$ is exceeded, the output of comparator 25, which forms the fourth input to OR gate 10, will go high.

A power supply module 27 takes an external supply voltage $V_{EXT}$ and generates a voltage V+ for powering all the circuitry mentioned earlier.

The use of a thermopile in an NDIR sensor that is part of a fire detection system represents a considerable departure from the conventional wisdom in the gas-sensing field. This is so because a thermopile produces a smaller signal with a lower signal-to-noise ratio than, for example, a pyroelectric sensor. The fact that the present invention combines a smoke detector with the NDIR $CO_2$ sensor helps to make this application practical by reducing the requirement for accuracy of the NDIR $CO_2$ sensor. Moreover, the use of a thermopile reduces the overall cost of the fire detection system.

Figure 2B:
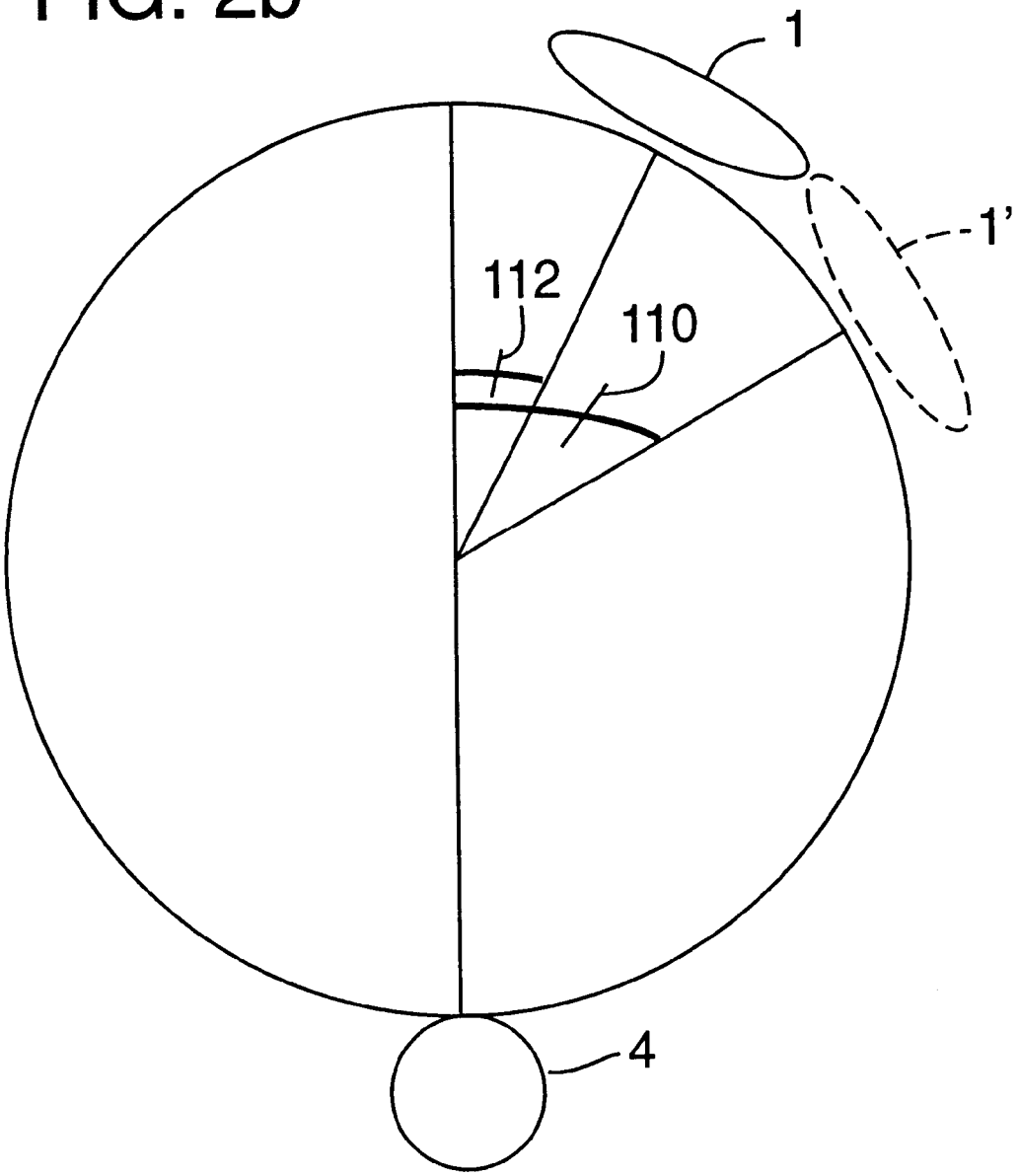
FIG. 2*b* is an illustration of a photoelectric smoke detector that may be implemented as part of the invention and showing its angle of reflection compared to the angle of reflection in a prior art smoke detector.

An advantage of combining photoelectric smoke detector 2 with NDIR $CO_2$ detector 14 is that smoke detector 2 can be optimized for the detection of comparatively large smoke particles produced by a smoldering fire. FIG. 2*b* illustrates this feature. In prior art smoke detectors, a photodiode 1' would be located at a relatively large reflection angle 110, typically 60°. This angle permits the detection of the very black smoke particles produced by certain types of flaming fires. Unfortunately, the detection of the large smoke particles produced by a smoldering fire is suboptimal at this angle. In the present invention, the detection of very black smoke particles is not so critical because the $CO_2$ detector responds to flaming fires. Therefore, in the preferred embodiment photodiode 1 is positioned as shown in FIG. 2*b*, at a reflection angle 112 of less than 60°. Skilled persons currently consider 30° to be a close to optimal angle for the detection of the large smoke particles produced by nonflaming fires yet retaining some fine smoke particle detection capability.

Alternatively, a projected beam or extinguishment smoke detector could be used as a substitute for photoelectric smoke detector 2. Extinguishment smoke detectors direct a beam of light through the atmosphere to a light detector. The attenuation caused by smoke is measured. This type of detector is very popular for use in a cavernous indoor space, such as an atrium. Additionally, advancements in technology are reducing the cost and improving the accuracy of extinguishment detectors that are produced in a single housing. One advantage of extinguishment detectors is that they are sensitive to the fine particle smoke that is produced by a flaming fire. Because the use of an additional sensor reduces the requirements for accuracy of the smoke detectors, it would be possible to use a relatively inexpensive extinguishment detector in the present invention.

Another advantage of combining a $CO_2$ detector 14 with smoke detector 2 is that it permits the design of a fire detector with greatly decreased cleaning requirements. The reason is that a process of correction, which is sometimes called a floating background adjustment, becomes beneficial over time as greater amounts of dust settle onto the interior surfaces of a smoke detector. The amount of light received by photodiode 1 under nonfire conditions (i. e., the nonfire signal level) gradually increases as a consequence of light reflections caused by the accumulation of dust on the interior surfaces. The smoke detection alarm, undersensitivity, and oversensitivity thresholds may be increased in proportion to the nonfire signal produced. This floating background adjustment may be made either in an ASIC 28 (FIG. 3*a*) or in a fire alarm control panel 640 (FIG. 3*a*), depending on the thresholding scheme implemented.

A smoke detector in which a floating background adjustment is implemented as an internal part of the smoke detector is described in PCT publication number WO 96/07165 (Mar. 7, 1996), which is assigned to one of the assignees of this application and the subject matter of which is hereby incorporated by reference as if fully set forth herein.

There are available smoke detector systems that have multiple spot smoke detectors, each connected to a control panel located remotely from each spot smoke detector. Each spot smoke detector is thus located in a housing separate from the housing of the control panel. The control panel addresses each spot smoke detector individually and evaluates the output of each smoke detector individually. In determining whether the output of any individual smoke detector indicates an alarm condition, the control panel performs an adjustment to compensate for drift in the output of that smoke detector. These systems are referred to as "addressable smoke detector systems." There are also available smoke detector system that transmit a beam from a transmitter to a receiver located as far as 100 to 300 feet (and thus in a separate housing) from the transmitter and that compensate for drift in the output of the receiver. These systems are referred to as "beam smoke detection systems." Some such systems perform drift compensation in the receiver. Other such systems perform drift compensation in a control panel that addresses one or more separate receivers. In either type of beam smoke detection system, the components of the system are contained in more than one housing.

Because of a possibility that an extremely slow burning fire might appear to a detector with the system of automatic threshold adjustments described above to be a rapid deposition of dust, it is generally considered unsafe to permit an alarm threshold adjustment above a light obscuration level of 4% per 0.3048 meter (1 foot). Therefore, at the point where the corrected signal threshold level would exceed this maximum level, the smoke detector is cleaned.

Because the system of the present invention relies upon smoke detector 2 and $CO_2$ detector 14, it is possible to considerably lower the smoke concentration thresholds. This means that considerably more correction may be performed before encountering the maximum signal limit. The presence of $CO_2$ detector 14 allows a reduction of the alarm threshold of a smoke detector 2 implemented with a floating background adjustment capability because the latter need not detect flaming fires. The alarm threshold of smoke detector 2 can be reduced to about 0.5% per 0.3048 meter (1 foot) in conjunction with an introduction of a delay time window of sufficient duration for smoldering fires, which grow slowly, to intensify. A delay time window of about four minutes meets this criterion and is longer than the time it takes for common causes of false alarms (e.g., tobacco smoke and bathroom shower steam) to subside.

A smoke detector 2 operating to detect flaming fires at acceptable false alarm rates typically is set at about a 3% per 0.3048 meter (1 foot) alarm threshold and, therefore, has a permissible drift tolerance of only 1% (from 3% to 4% per 0.3048 meter (1 foot)). Setting the alarm threshold to 0.5% per 0.3048 meter (1 foot), together with introducing a delay time window, provides a permissible drift tolerance of 3.5% (i.e., from 95% to 4%). Therefore, dust may accumulate on the interior surfaces in sufficient amounts to cause the nonfire signal level of photodiode 1 to equal 3.5% light obscuration per 0.3048 meter (1 foot) before cleaning would be required. Because it typically takes five years for a dust layer to accumulate to a sufficient thickness to cause a 1% light obscuration per 0.3048 meter (1 foot) reflection, this type of smoke detector could remain in place for 17.5 years before cleaning would be required. This system design could, therefore, greatly increase the maintenance interval and could even permit the design of a smoke detector that would likely be replaced before cleaning would be required.

Figure 3A:
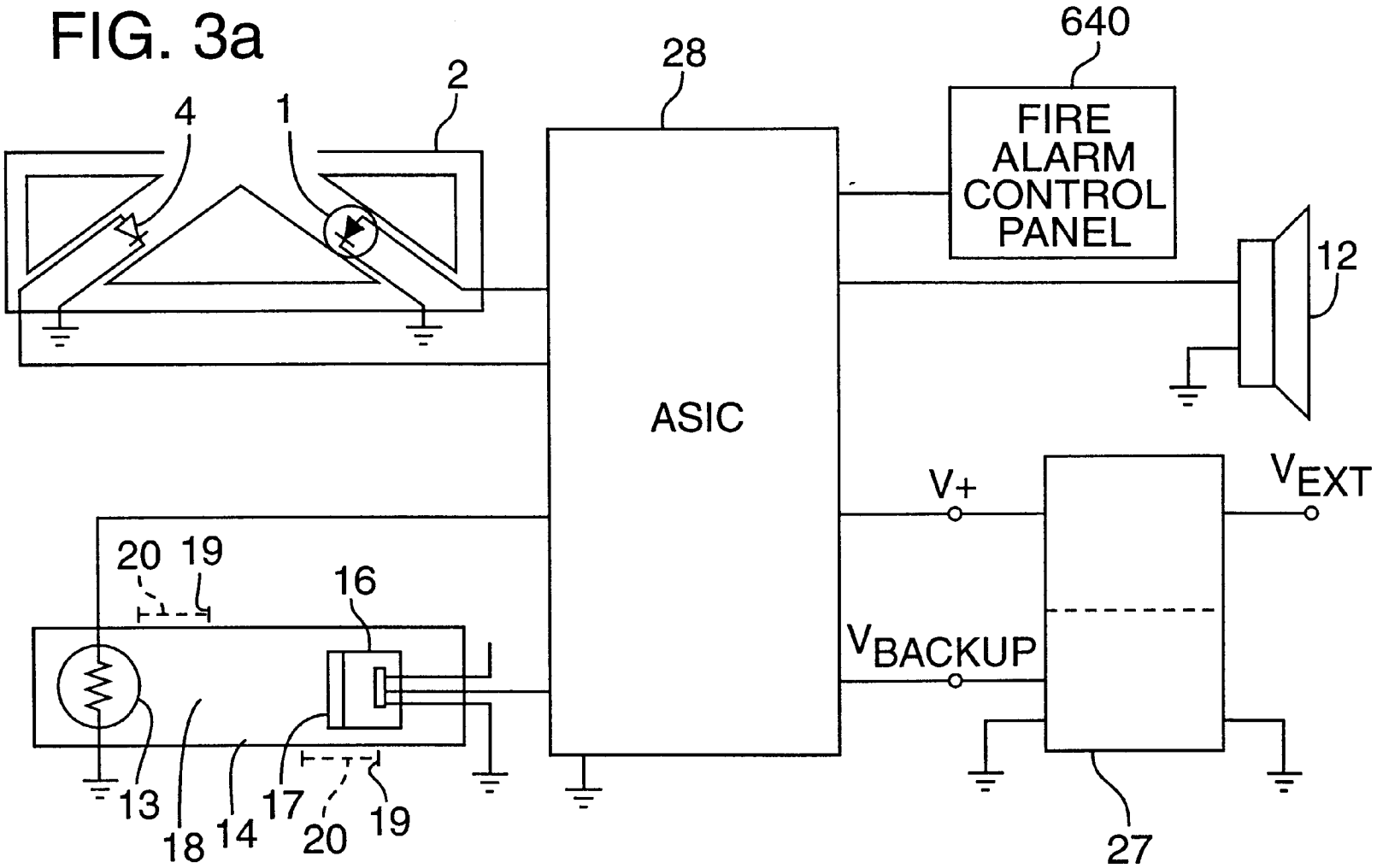
FIG. 3*a* is a schematic layout of a first alternative preferred embodiment of the invention for a practical and improved fire detection system.

In a first alternative preferred embodiment shown in FIG. 3*a*, all the circuit elements described and shown in FIG. 2*a*, with the exception of smoke detector 2, $CO_2$ detector 14, power supply module 27, and auditory alarm 12, are integrated using standard techniques into a single ASIC chip 28. Additionally, ASIC 28 may include circuitry for digitizing and formatting the signals representing $CO_2$ level, rate of change of $CO_2$, smoke concentration level, and the presence of an alarm signal. Such circuitry would typically include an analog-to-digital converter and a microprocessor section for formatting the signal into a serial format.

The digitized signals are transmitted typically over a serial bus to a fire alarm control panel 640. Serial communications are a natural choice because the volume of data is typically low enough to be accommodated by this method and reducing power consumption is a consideration.

Fire alarm control panel 640 preferably performs the data analysis to determine the presence of a fire. In this instance, the fire detection system is considered to encompass fire alarm control panel 640.

Figure 3B:
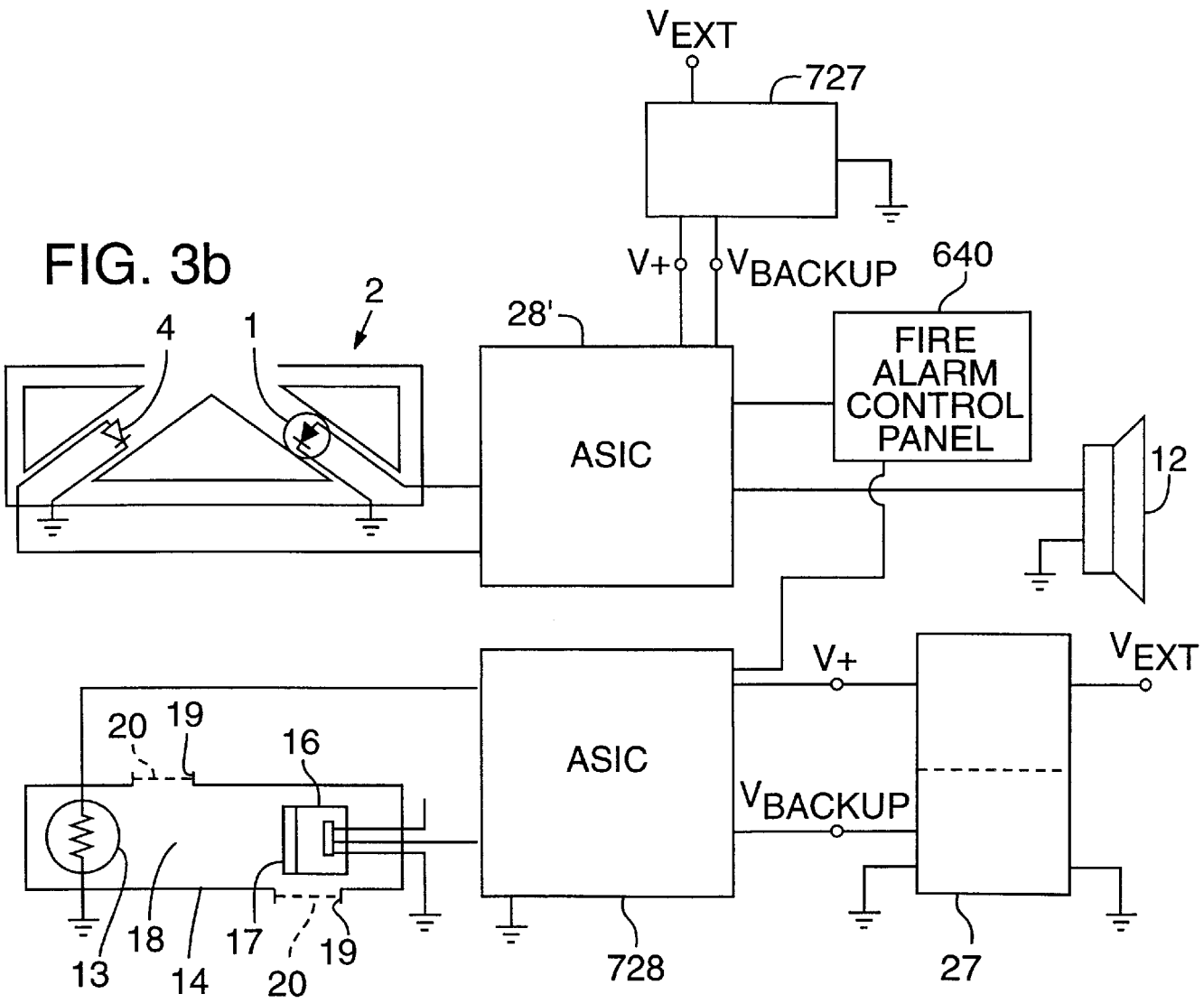
FIG. 3*b* is a schematic layout of a variant of the first alternative preferred embodiment.

In a variant of this alternative preferred embodiment, shown in FIG. 3*b*, a first ASIC 28' receives, digitizes, and formats the signal received from smoke detector 2. ASIC 28' sends the resultant data to fire alarm control panel 640. A second ASIC 728 receives, digitizes, and formats the signal received from infrared detector 16. ASIC 728 sends the resultant data to fire alarm control panel 640. A second power supply module 727 powers first ASIC 28'. In this embodiment, ASIC 28' and smoke detector 2 may be physically separate and a distance away from ASIC 728 and $CO_2$ detector 14.

Figure 4A:
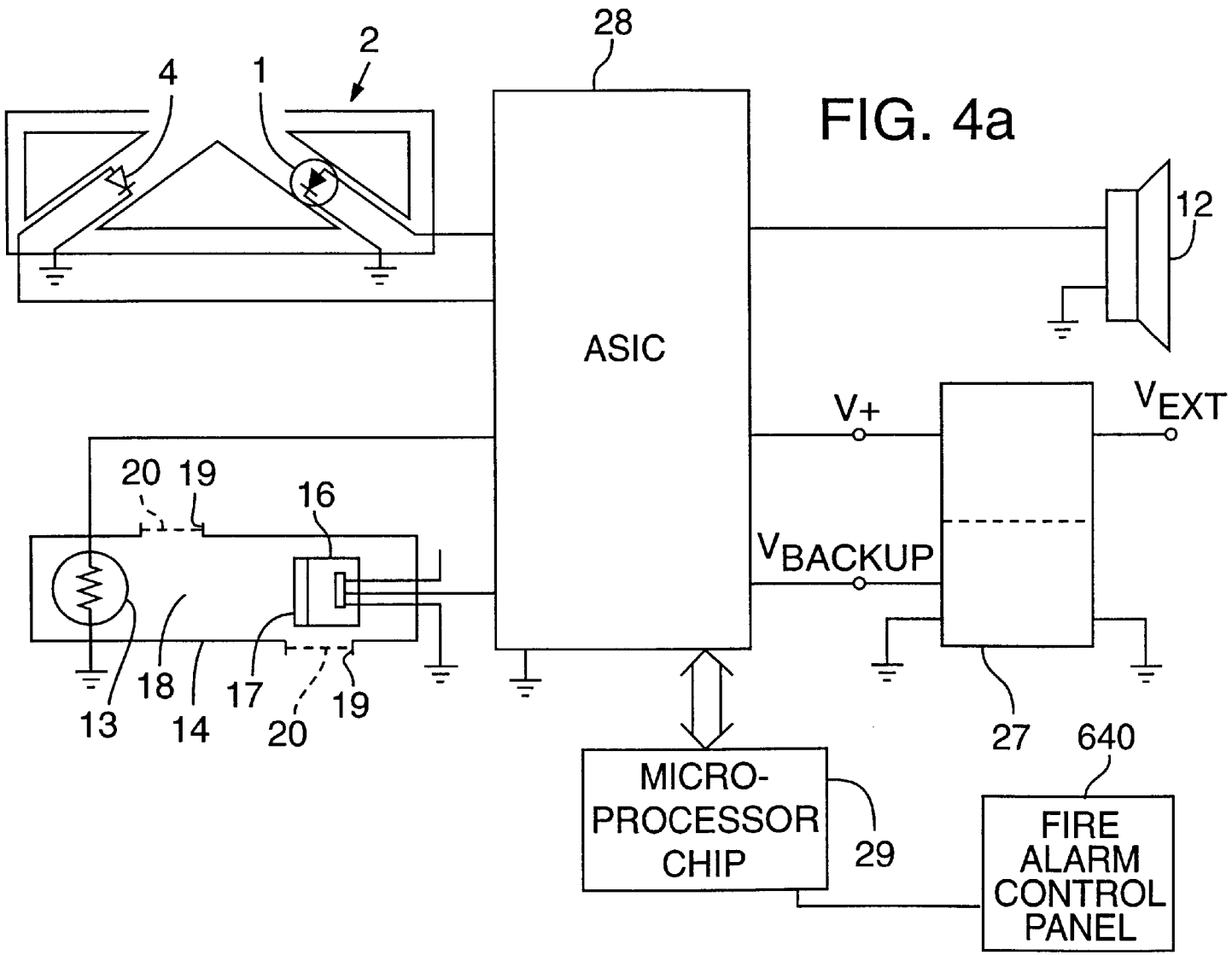
FIG. 4*a* is a schematic layout of a second alternative preferred embodiment of the invention for a practical and improved fire detection system.

In a second alternative preferred embodiment shown in FIG. 4*a*, a microprocessor 29 communicates with ASIC 28 via a data bus. Commercially available microprocessors typically do not produce outputs capable of driving LED 4 and infrared source 13. Therefore ASIC 28 includes driver circuitry for performing these functions. ASIC 28 also includes an analog-to-digital (A/D) converter and amplifiers for converting the sensor outputs into a form that is in the voltage range of the A/D converter. Microprocessor 29 receives the digitized data from the A/D converter and is programmed to compute the smoke concentration, the $CO_2$ concentration, and the rate of change of $CO_2$ concentration and to implement the detection logic shown in FIG. 1. ASIC 28 receives digital results of this process from microprocessor 29 and changes an alarm declaration into a form that can drive alarm 12.

In one variation of the second alternative preferred embodiment, smoke and $CO_2$ concentration samples produced by the A/D converter are operated on by a digital filter implemented in microprocessor 29. The output of the digital filter is compared with a threshold in order to determine the presence of an alarm condition. Smoke concentration sample "A1" (taken at a rate of 0.1 Hz) is sent through an alpha filter of the following form:

$$A1_N'=\alpha A1_N+(\alpha-1)A1_{N-1}'$$

where $A1_N$ is the most recent smoke concentration sample, $A1_{N-1}'$ is the previous alpha-filtered smoke concentration value, and $A1_N'$ is the newly computed, alpha-filtered smoke concentration value. The value of $\alpha$ is set to 0.3, and a threshold is set equal to a constant light obscuration level of 4% per 0.3048 meter (1 foot). The $CO_2$ concentration rate samples ("$A2_N'$," computed at a rate of 1 every 10 seconds) are also operated on by an alpha filter. The value of the $CO_2$ concentration rate $\alpha$ is set to 0.2, and an alarm threshold is set equal to a rate of change of 500 ppm/min. In addition, every 10 second time interval a quantity $Q_N$ is formed by the following equation:

$$Q_N=A1_N'+A2_N'$$

where $A1_N'$ has been normalized so that 1% light obscuration per 0.3048 meter (1 foot) is set to equal 1.0 and $A2_N'$ has been normalized so that a 150 ppm/min rate is set to equal 1.0. An alarm threshold for $Q_N$ is set to 1.8. When any one of the alarm thresholds is exceeded, an alarm indication is provided to a user or to a recipient device.

In this embodiment, $A1_N'$ and $A2_N'$ could be operated on by a linear, quadratic, or other polynomial form equation prior to combination. For instance $Q_N$ could have the following form:

$$Q_N=a_1(A1_N')^2+b_1A_1+a_2(A2_N')+b_2A2_N'+c.$$

In this case $a_1=0.1$; $b_1=1.0$; $a_2=0.1$; $b_2=1.0$; and $c=0$. The general purpose of having the quadratic terms is to declare an alarm when one quantity becomes large when the other quantity is small.

An alpha filter is one example of a recursive or infinite impulse response (IIR) filter. A finite impulse response (FIR) filter could also be used. A good FIR filter would likely be responsive to instantaneous level, rate of change (the first derivative), and the derivative of the rate of change (the second derivative). For example, a three sample FIR filter would have the following form:

$$A1_N'=k_1A1_N+k_2A1_{N-1}+k_3A1_{N-2}$$

$$A2_N'=k_1A2_N+k_2A2_{N-1}+k_3A2_{N-2}$$

$$Q_N=A1_N'+A2_N'.$$

The constant values $k_1=4.0$; $k_2=-2.5$; and $k_3=0.5$; yield a filter that responds to instantaneous level, rate of change, and acceleration over a three sample interval. Multiplication by these simple constants would readily implemented on a microcomputer. Skilled persons will appreciate that a digital filter could also be implemented in hardware with a number of delay or sample and hold circuits and amplifiers set to the desired constants.

Alternatively, $Q_N$ could have one of the following forms:

$$Q_N=\text{MAX}\{A1_N', A1_{N-1}', A1_{N-2}', A1_{N-3}'\}+\text{MAX}\{A2_N', A2_{N-1}', A2_{N-2}', A2_{N-3}'\}$$

or $$Q_N=\text{AVERAGE}\{A1_N', A1_{N-1}', A1_{N-2}', A1_{N-3}'\}+\text{AVERAGE}\{A2_N', A2_{N-1}', A2_{N-2}', A2_{N-3}'\}.$$

These forms are desirable because at a sensing location located on a ceiling, $CO_2$ concentration typically peaks before smoke concentration peaks. The above forms for $Q_N$ take this into account so that if there is a lag between the $CO_2$ concentration rate peak and the smoke concentration peak an alarm will nevertheless be declared if the smoke concentration exceeds a predetermined level within (before or after) a predetermined time period of the existence of a condition defined by the $CO_2$ concentration rate being greater than a predetermined rate. In one case, $A1_N'$ and $A2_N'$ reduce to $A1_N$ and $A2_N$.

Figure 4B:
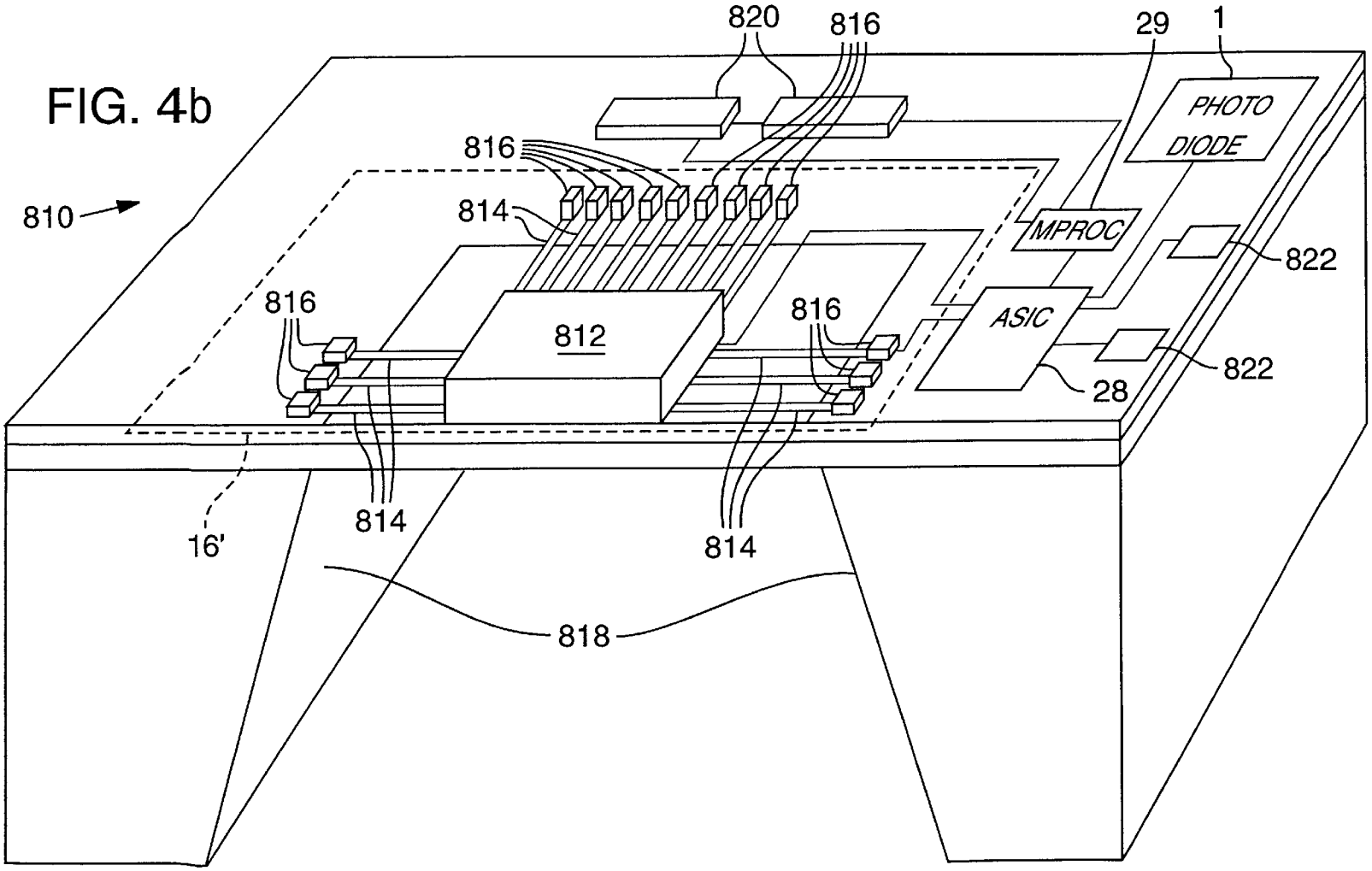
FIG. 4*b* is a greatly expanded isometric drawing of a sensor/integrated circuit that forms a portion of the second alternative preferred embodiment.

FIG. 4*b* is a greatly expanded illustration of what the drivers, sensors, amplifiers, and signal processing circuitry of the second alternative embodiment look like physically. A combination sensor/integrated circuit 810 is positioned so that infrared light will strike a light absorptive material surface 812 of a thermopile portion 16' of combination sensor/integrated circuit 810. A series of metallic strips 814 connect a set of hot junctions (hidden by light absorptive material surface pad 812 in FIG. 4*b*) to a set of cold junctions 816. The difference in temperature caused by the light absorptive material surface 812 is translated into an electrical potential difference at each hot junction and each cold junction 816. These electrical potentials are connected in series, and the resultant sum potential difference is an input to ASIC 28. The thermopile structure is made more heat responsive to infrared light by the presence of a micromachined indentation 818 on the back side of combination sensor/integrated circuit 810.

ASIC 28 has been formed using standard integrated circuit fabrication techniques into the silicon substrate of combination sensor/integrated circuit 810. Photodiode 1 is also etched onto the surface of combination sensor/integrated circuit 810 and is electrically connected to ASIC 28. ASIC 28 amplifies the sum potential difference signal from thermopile section 16' and photodiode 1 and feeds these converted signals into an A/D converter, which feeds the digitized signal into microprocessor 29. Microprocessor 29 performs the detection logic and emits the resultant digitized serial signal over output terminals 820. Pulse train generators 612 and 614 and drivers 5 and 15 (FIG. 2*a*) are also fabricated into ASIC 28, which is electrically connected to photodiode 1 and infrared source 13 by way of output terminals 822.

As those skilled in the art will recognize, this configuration allows for the economical production of combination sensor/integrated circuit 810. The process may begin with the production of a microprocessor integrated circuit according to an existing design. ASIC 28 may be etched into an unused portion of the substrate using standard photolithographic techniques during production. Subsequently, both thermopile portion 16' and photodiode 1 may be constructed on the top surface of the die.

Figure 5:
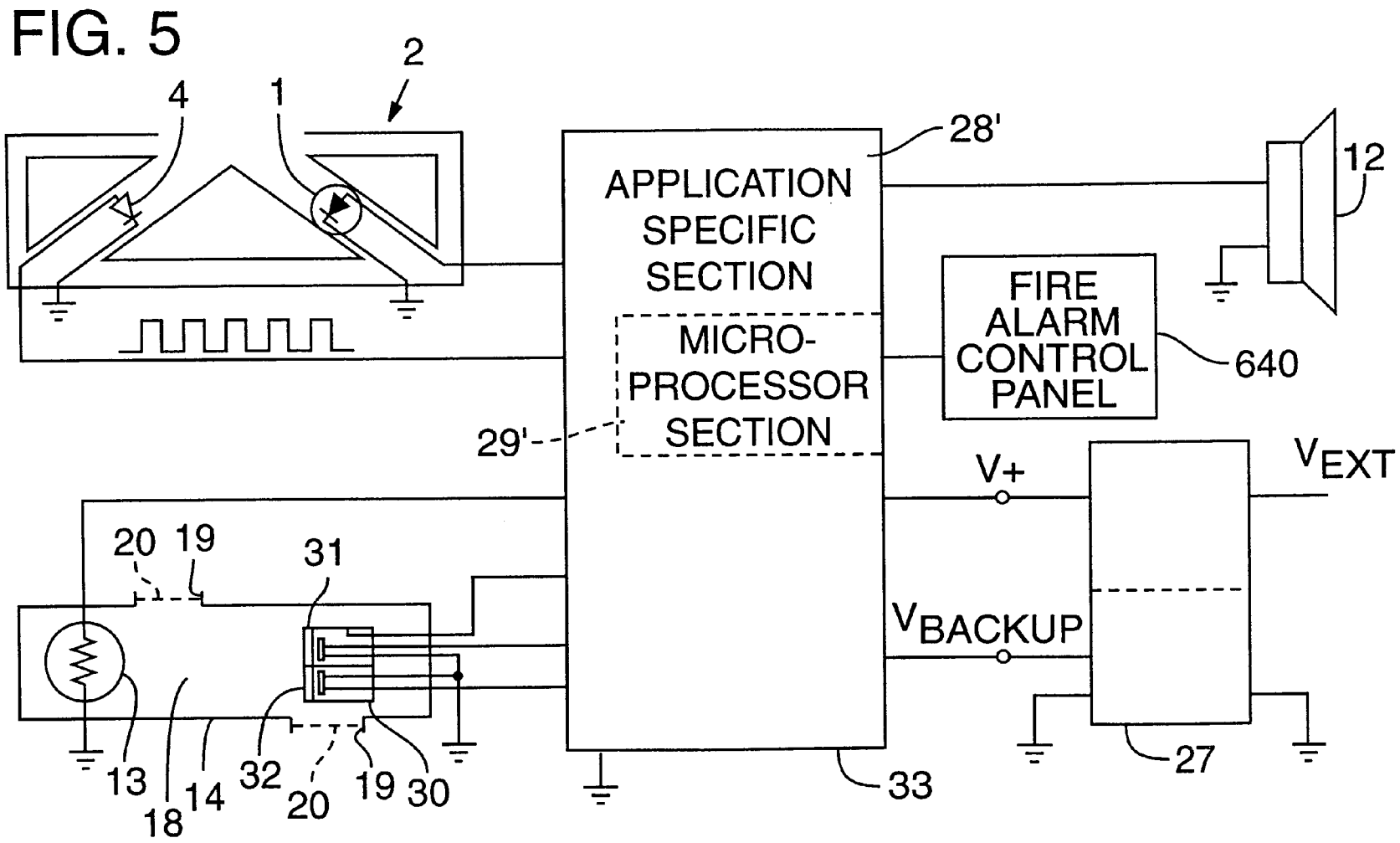
FIG. 5 is a schematic layout of a third alternative preferred embodiment of the invention for a practical and improved fire detection system.

A third alternative preferred embodiment, shown in FIG. 5, improves on the accuracy of NDIR $CO_2$ gas detector 14 relative to the first alternative preferred embodiment. Although smoke is filtered out of sample chamber 18 in both embodiments, there is still some potential for inaccuracy of detector 14 because of the effects of temperature variations and aging. To correct for these phenomena, infrared detector 16 (FIG. 2), which has only one channel, is replaced by a dual-channel silicon micro-machined thermopile detector 30. A first optical filter 31, which covers a first channel portion of the surface of detector 30, is a thin film narrow bandpass interference optical filter having a center wavelength at 4.26 microns and a FWHM bandwidth of 0.2 micron, thereby causing the first channel of detector 30 to respond to changes in the concentration of $CO_2$. A second optical filter 32, which covers a second channel portion of the surface of detector 30, has a center wavelength at 3.91 microns and a FWHM bandwidth of 0.2 micron. The second channel of detector 30 establishes a neutral reference for gas detector 14 because there is no appreciable light absorption by common atmospheric gases in the pass band of optical filter 32. The light attenuation attributable to the presence of $CO_2$, which translates directly to the concentration of $CO_2$, is determined by forming the ratio of light received by the first channel of detector 30 over the light received by the second channel of detector 30 and applying simple algebra.

The third alternative preferred embodiment includes a signal processing (SP) integrated circuit 33 that comprises a microprocessor section 29' and an application specific section 28'. Microprocessor section 29' receives the digitized data from the A/D converter and is programmed to compute the smoke concentration, the $CO_2$ concentration, and the rate of change of $CO_2$ concentration and to implement the detection logic shown in FIG. 1. The $CO_2$ concentration may then be computed by measuring the ratio of the digitized signals from the two channels of detector 30. Further processing may then be performed on the digitized results. Application specific section 28' receives digital information from microprocessor section 29' and changes it into a form that can drive the alarm device.

Figure 6:
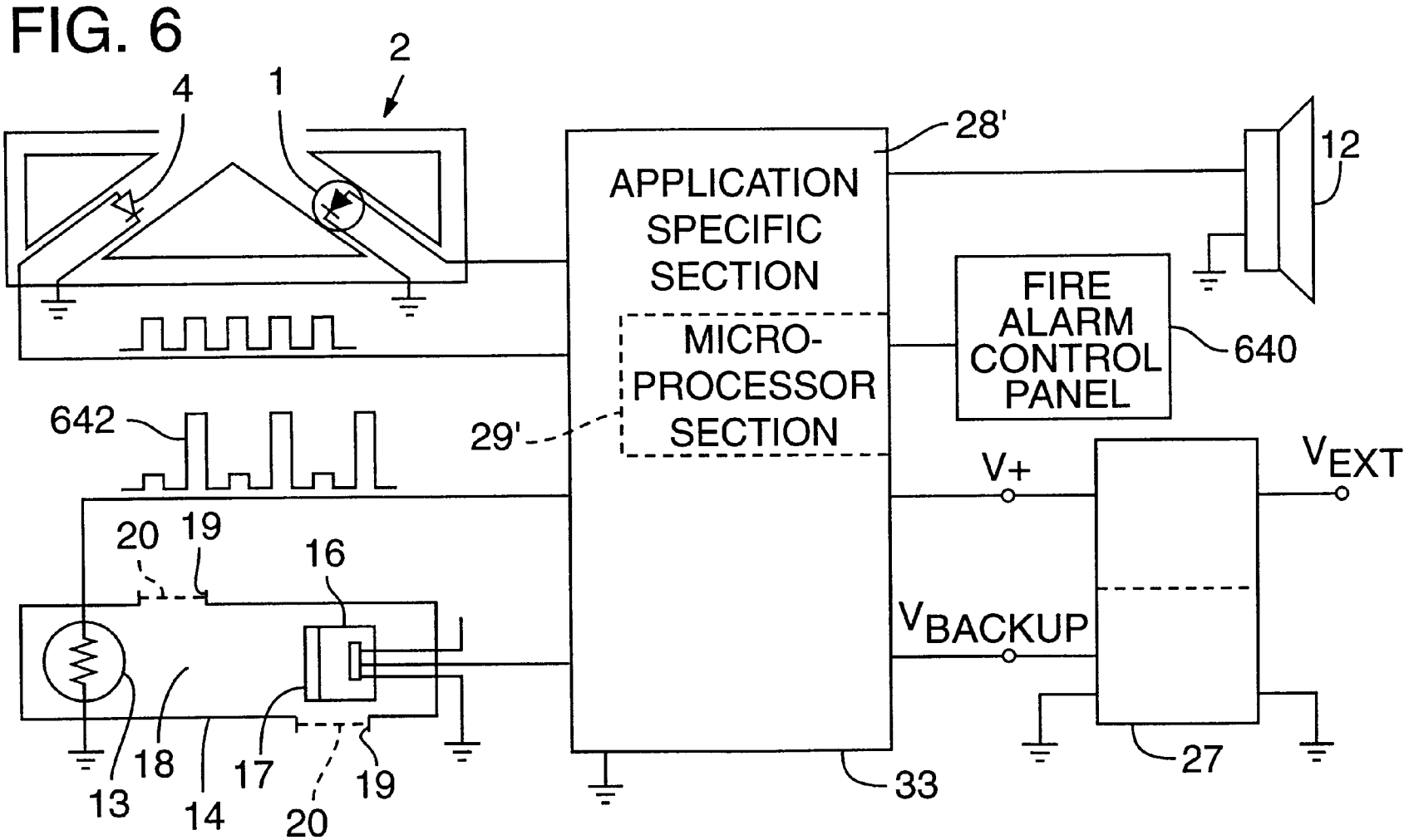
FIG. 6 is a schematic layout of a fourth alternative preferred embodiment of the invention for a practical and improved fire detection system.

In a fourth alternative preferred embodiment shown schematically in FIG. 6, $CO_2$ gas detector 14 is implemented with a gas analysis technique known as "differential sourcing" as disclosed in U.S. Pat. No. 5,026,992, which is assigned to one of the assignees of the present application. This implementation permits a scheme to correct for amplitude variations in 4.26 micron wavelength light received by infrared light detector 16 caused by factors other than $CO_2$ concentration, such as temperature variations, but without requiring a dual pass band infrared detector as in the second alternative preferred embodiment.

In this embodiment, the signal processor (SP) chip 33 comprising both microprocessor section 29' and the application specific section 28' used in the third alternative preferred embodiment (FIG. 5) is retained. The ASIC section generates a waveform 642, which comprises a pulse stream of two alternating power levels, to drive the infrared source 13. This permits the use of a single-channel infrared light detector 16 covered by dual pass band optical filter 17 having a first pass band centered at 4.26 microns ($CO_2$) and a second pass band centered at 3.91 microns (neutral).

Both pass bands have a 0.2 micron FWHM bandwidth. The quantity of 4.26 micron light reaching infrared light detector 16 depends, in part, upon the concentration of $CO_2$ gas present between source 13 and detector 16.

The scheme to correct for light detection variations unrelated to $CO_2$ concentration depends on the fact that infrared source 13 emits a different proportion of 4.26 micron light, relative to 3.96 micron light when infrared source 13 is pulsed on at a higher power level compared to when it is pulsed on at a lower power level. The light attenuation of $CO_2$ is determined by forming the ratio of light received by infrared light detector 16 when infrared source 13 is pulsed on at the higher power level over the light received by infrared light detector 16 when infrared source 13 is pulsed off or pulsed on at the lower power level. Simple algebra carried out in microprocessor section 29' yields the light attenuation due to $CO_2$, which translates directly to $CO_2$ concentration.

In an additional alternative preferred embodiment, optical filter 17 has a pass band from 3.8–4.5 microns. Light source 13 is tunable and produces a very narrow spectrum of light. One device that fits this criterion is a tunable laser diode. Light source 13 is alternately tuned to 3.96 microns and 4.26 microns. Once again, simple algebra implemented in microprocessor section 29' yields the $CO_2$ concentration.

Figure 7:
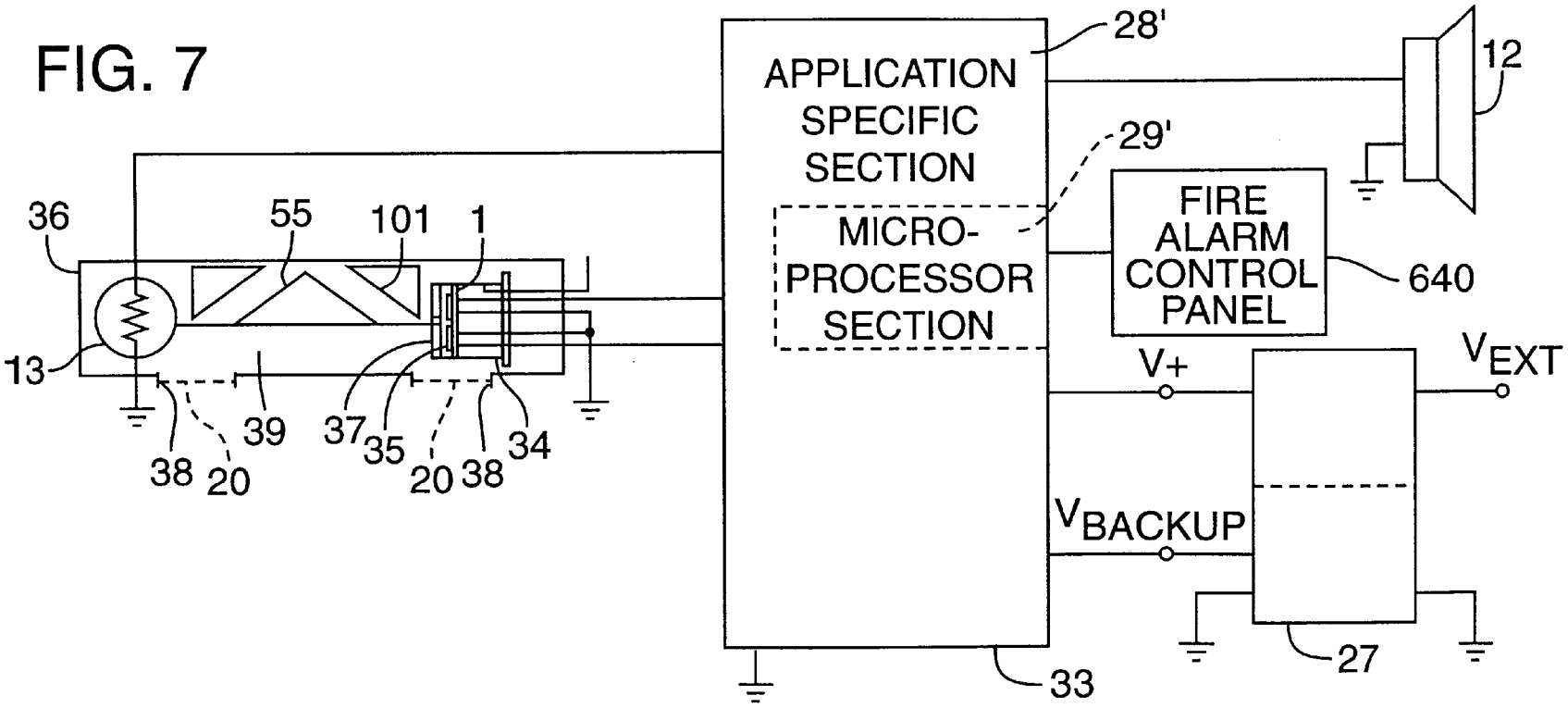
FIG. 7 is a schematic layout of a fifth alternative preferred embodiment of the invention for a practical and improved fire detection system.

In a fifth alternative preferred embodiment of the present invention as shown schematically in FIG. 7, photoelectric smoke detector 2 and NDIR $CO_2$ detector 14 are combined into a single device or detector assembly contained within a single housing 36. A dual-channel detector 34 housed within housing 36 includes a first channel comprising a thermopile detector 35 with a $CO_2$ optical filter 37 (having a passband centered at 4.26 micron wavelength and a 0.2 micron FWHM bandwidth) and a second channel comprising silicon photodiode 1 fabricated in the vicinity of and on the same substrate as detector 35 but optically isolated from it. Alternatively, the elements enclosed within housing 36 include a single-channel thermopile detector 35 with a dual passband optical filter that has a first passband centered at 4.26 microns ($CO_2$) and a second passband centered at 3.91 microns (neutral). In this alternative, infrared source 13 emits a time varying signal, as in the fourth alternative embodiment illustrated in FIG. 6, so that a reference may be maintained as is described in the description of FIG. 6. Light source 13 is typically an incandescent bulb but may alternatively be a tunable laser diode. In an additional alternative, the $CO_2$ detecting mechanism inside housing 36 comprises a double channel thermopile as is illustrated in FIG. 5.

Infrared source 13 is a broad band source that emits both 4.26 micron wavelength light for $CO_2$ absorption and detection and 0.88 micron wavelength light for the detection of smoke particles that are smaller than a micron. Inside housing 36, there is a physical light-tight barrier 55 separating the two detector channels. On the $CO_2$ detector side, two or more small openings 38 are made on one side of the container wall opposite barrier 55 that allow ambient air to freely diffuse into and out of a sample chamber 39 of the $CO_2$ detector. Furthermore, these small openings are covered with a fiberglass-reinforced silicon membrane 20 for screening out any dust, smoke, or moisture from sample chamber 39. $CO_2$ and other gases can diffuse freely across this membrane 20 without hindrance.

A photoelectric smoke detector side 101 within housing 36 operates in the same manner as smoke detector 2 of FIG. 1. Photodiode 1 is configured to respond to a 0.88 micron wavelength emitted by light source 13 to provide a signal representative of smoke concentration. Application specific section 28' amplifies the electrical signal produced by photodiode 1. Microprocessor section 29' of signal processor chip 33 processes the resultant data in the same manner as in the preferred embodiment shown in FIG. 2*a* and described in the accompanying text.

As those skilled in the art will readily recognize, there are a number of ways to manufacture or configure a single-channel infrared detector 16, a dual-channel infrared detector 30, and a dual-channel detector 34, the last of which is composed of a thermopile detector channel 35 and a photodiode detector 1. With respect to detectors 16 and 30, however, the detector and corresponding bandpass optical filter(s) are preferably combined in a single platform such as a TO-5 device package to form an infrared detector assembly. The physical construction of a thermopile/bandpass optical filter combination is described below as part of the description of a passive infrared analysis detector.

The embodiment of FIG. 7 affords an ability to determine when light source 13 fails to emit sufficient light to enable photoelectric smoke detector 2 and NDIR $CO_2$ detector 14 to function properly. Such failure could result from, for example, light bulb deterioration, the presence of dust, or electrical power delivery problems. Microprocessor section 29' monitors the photodiode 1 and thermopile detector 35 output signals to determine whether a contemporaneous diminution of a predetermined amount in their levels has occurred. A significant common signal level drop would indicate the existence of a problem with light source 13, which provides light to both detectors, and can be the basis for microprocessor 29' to produce a light source failure warning signal.

A preferred construction of a thermopile/optical bandpass filter combination is described in connection with FIGS. 9–16 of the U.S. patent application Ser. No. 08/583,993, filed Jan. 10, 1996, for PASSIVE INFRARED ANALYSIS GAS SENSORS AND APPLICABLE MULTICHANNEL DETECTOR ASSEMBLIES, the description of which is hereby incorporated by reference as if fully set forth herein.

The embodiment of FIG. 7 permits an additional feature for increasing the accuracy of both the smoke detector and the $CO_2$ detector. One of the sources of inaccuracy typically encountered in NDIR $CO_2$ detectors is the poor repeatability of the light amplitude produced by light source 13. Typically an incandescent bulb, light source 13 is pulsed with just enough electricity to briefly heat the filament to the level at which it produces infrared light at the 4.26 micron wavelength. There are, however, frequently slight variations in the light intensity produced. By comparing the intensity of light detected by photodiode 1 and by infrared light detector 16, the calculations of smoke concentration and $CO_2$ concentration can be corrected. A simple dual detector could be designed in which the following ratio is compared with a threshold to determine the presence of an alarm condition:

$$\frac{\text{Smoke Concentration Measurement}}{\text{CO}_2\text{ Concentration Measurement}} = \frac{\text{Light Source Intensity} \times \text{Smoke Concentration}}{\dfrac{\text{Light Source Intensity}}{\text{CO}_2\text{ Concentration}}} = \text{Smoke Concentraion} \times \text{CO}_2\text{ Concentration}$$

This ratio is independent of light source intensity; therefore, it is not susceptible to errors caused by variations in light source intensity. This is only one example of ways in which the $CO_2$ detector output and smoke detector output can be used to mutually correct each other for variations in light source intensity.

Similarly, in connection with dual-channel detector 34 described in connection with FIG. 7, the same principles of construction are equally applicable to the combination of micro-machined thermopile detector 35 and $CO_2$ optical filter 37. Further, as is shown in FIG. 4*b*, it is possible to fabricate silicon photodiode 1 (or a thermopile performing the same function as photodiode 1) on the same silicon substrate as thermopile detector 35.

FIG. 8 is a high-level block diagram of a set of logic functions 210 of a sixth alternative preferred embodiment of a fire detection system according to the present invention. This logic can be implemented in a microprocessor such as microprocessor 29 (FIG. 4*a*). Alternatively, this logic could be implemented in a fire alarm control panel such as panel 640.

An atmospheric condition monitor 212 examines the ambient air for characteristics such as $CO_2$ concentration and smoke concentration. Monitor 212 could be, for example, as shown by FIG. 4*a*, elements 1, 2, and 4 and elements 13, 14, 16–20, 27, and 28. Measurements of these characteristics are sent to, among other elements, a disable/reenable air conditioner logic block 214. The purpose of block 214 is to determine when tentative, subtle indications of fire are present. Sounding an alarm upon the detection of these indications would cause a false alarm rate so high that it would inconvenience the building occupants. If the air conditioning system turns on coincidentally with the occurrence of a fire, however, the air from the air conditioning system would mask the effects of the fire by dispersing the smoke and the $CO_2$. The activation of the air conditioning system would also be likely to feed oxygen to the fire. To counter this potential phenomenon, logic block 214 disables the air conditioning system upon the tentative detection of a fire.

Subsequent to the tentative fire declaration, block 214 removes the tentative fire declaration and reenables the air conditioning system upon the satisfaction of any member criterion of a predetermined set of criteria. Because the tentative fire detections might be considerably more common than the fire alarms, it is desirable to reenable the air conditioning system automatically, rather than require human intervention.

If air condition monitor 212 includes a $CO_2$ detector, such as $CO_2$ detector 14 of FIG. 2*a*, the measurements of $CO_2$ concentration may be used to safeguard the environment against a high concentration of $CO_2$ by activating the air conditioning system when a high concentration of $CO_2$ is detected. Human alertness and productivity have been shown to suffer as the concentration of $CO_2$ rises. There are various requirements documents that are used in different parts of the world that specify an upper limit of $CO_2$ concentration for the workplace with the upper limit generally falling in the range of between 700–1,000 parts per million.

There may be an occasional conflict between a tentative fire declaration, indicating that the air conditioning system must be disabled, and an indication that the air conditioning system should be activated as a result of a high concentration of $CO_2$.

These conflicts are settled in favor of system disablement because of the importance of detecting fires. If the tentative fire detection is cleared in accordance with the operation of block 214, the air conditioning system may at that point be activated to flush out the air having a high concentration of $CO_2$. There will also be many instances when the $CO_2$ concentration is high enough to activate the air conditioning system and no conflicting tentative fire declaration has been formed as a consequence of a slow rate of rise of $CO_2$ concentration and the absence of smoke.

Although every fire is potentially very dangerous and requires a response, it is also important for fire departments to avoid overcommitting their limited resources to any particular fire in case a more serious fire suddenly erupts elsewhere. For this reason, this embodiment distinguishes between flaming and nonflaming fires. A flaming fire detection and alarm block 216 detects flaming fires and a nonflaming fire detection, and an alarm block 218 detects nonflaming fires.

Disable/reenable air conditioner logic block 214 includes a tentative flaming fire detection logic block 220, which compares the signals from atmospheric condition monitor 212 to predetermined tentative thresholds to make a tentative declaration of a flaming fire. The specific thresholds of one preferred embodiment are listed in Table 1, which follows. If any one of the thresholds is exceeded for a predetermined time, a tentative flaming fire detection bit 222 is set. (FIG. 9 and the accompanying text provide a more specific view of this process.) Bit 222 is applied to an input of a first two-input OR gate 224, the output of which, in turn, is connected to a disable input 226 of an air conditioner (not shown). Tentative flaming fire detection bit reset logic block 230 imposes a set of criteria on the output of condition monitor 212. When any one of the criteria is satisfied, tentative flaming fire declaration bit 222 is reset. A tentative nonflaming fire detection logic block 231, a tentative nonflaming fire detection bit 232, and a tentative nonflaming fire detection bit reset logic block 233 all perform the same function with respect to nonflaming fires as the respective elements 220, 222, and 230 perform with respect to flaming fires. The tentative nonflaming fire detection thresholds of block 231 are set lower than the corresponding tentative flaming fire thresholds of block 220, whereas the timing duration is slightly longer for the relatively slow detection of nonflaming fires.

Figure 9:
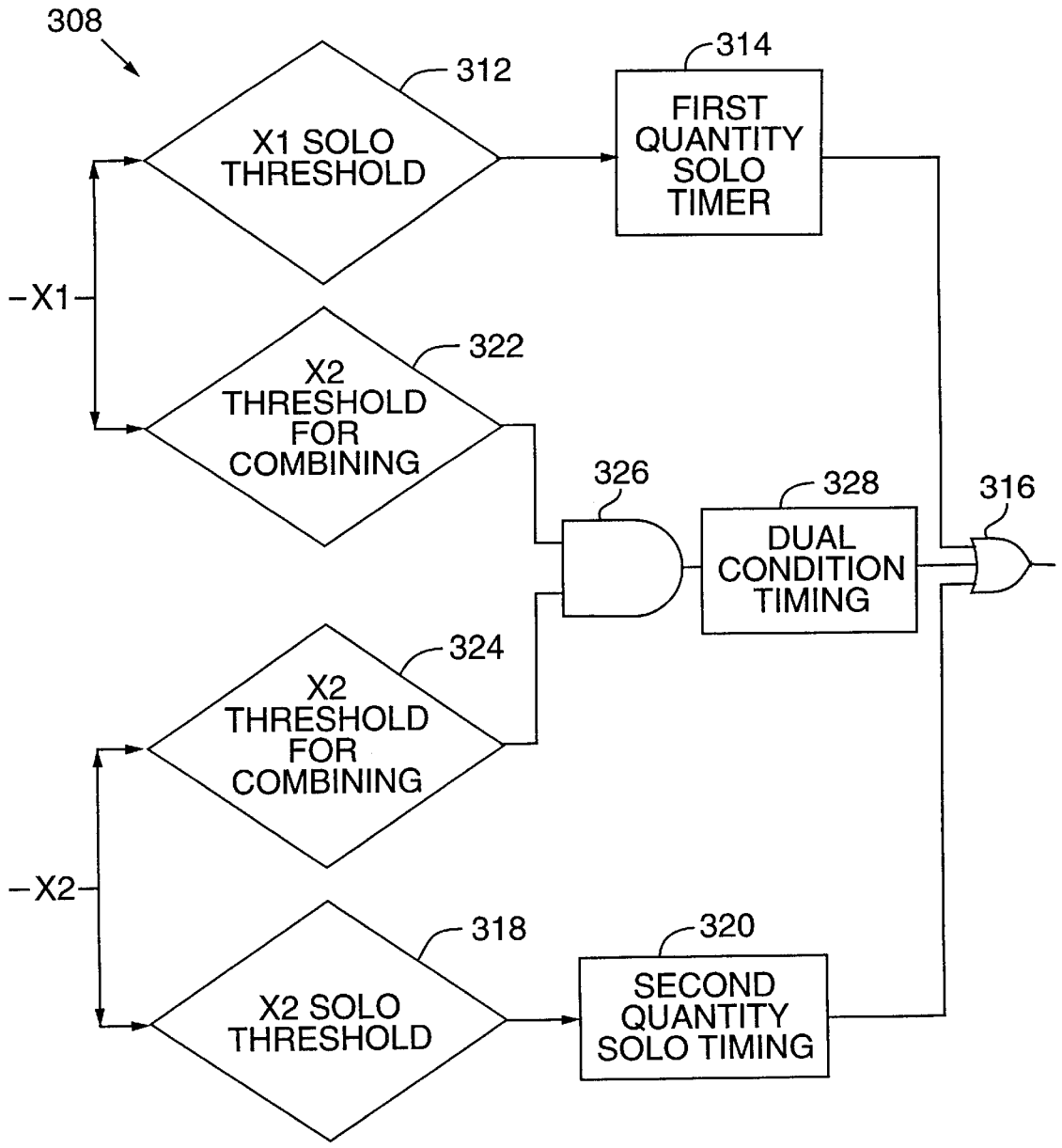
FIG. 9 is a generalized logic diagram representing the fictions carried out by each detection logic block of FIG. 8.

Flaming fire detection and alarm block 216 includes a conclusive flaming fire instant detection logic block 234. This block compares data received from atmospheric condition monitor 212 to a series of thresholds and timing conditions as indicated in FIG. 9. The output of block 234 is connected to a first input of a second two-input OR gate 236. After a conclusive threshold from block 234 is exceeded, a flaming fire alarm 238 is activated either immediately or after a timeout period of only a few seconds. To realize an acceptably low false alarm rate, these thresholds are set relatively high to avoid declaring an alarm based on a brief atmospheric aberration or measurement error. The alarm may be required to persist for a brief period to avoid false alarms. The thresholds of a conclusive flaming fire timed detection logic block 240 are set somewhat lower than the thresholds of block 234 because each condition that is indicated when one of these thresholds is exceeded is timed against one of the predetermined set of time periods that is longer than those of block 234. Therefore it is less likely that an alarm would be declared because of a measurement glitch or a brief atmospheric aberration.

Nonflaming fire detection and alarm block 218 performs the same function with respect to nonflaming fires as block 216 performs for flaming fires. Conclusive nonflaming fire instant detection logic block 244, a third two-input OR gate 246, a nonflaming fire alarm 248, a conclusive nonflaming fire timed detection logic block 250, and a conclusive nonflaming fire timing block 252 perform the same functions with respect to nonflaming fires as the respective elements 234, 236, 238, 240, and 242 perform with respect to flaming fires. In general, the time duration thresholds of nonflaming fire detection blocks 250 and 244 are longer than those of flaming fire detection blocks 240 and 234, whereas the smoke detection thresholds are lower.

FIG. 9 is a logic diagram describing the generalized detection logic block 308, which in a preferred embodiment describes each one of detection blocks 220, 231, 234, 240, 244, and 250 in set of logic functions 210. Typically, a first quantity, $X_1$, and a second quantity, $X_2$, would be, respectively, smoke concentration and rate of change of $CO_2$ concentration. It would also be possible, however, to compare the instantaneous concentration of $CO_2$ or the rate of change of smoke concentration to a threshold to determine the presence of an alarm condition. Additional candidate quantities for comparison against appropriate threshold values are concentration and concentration rate of $O_2$. Additionally, the concentration of fire-product gasses such as CO, water vapor, and MgO may be examined. Further additional candidate quantities could be the acceleration of the smoke concentration, $CO_2$ concentration, or any fire product gas. A first-quantity solo threshold decision block 312 tests the first-quantity against a first quantity threshold. If the first quantity exceeds this threshold for longer than the time duration imposed by a first-quantity solo timing block 314, the output of a three-input OR gate 316, which is also the output of the generalized detection logic block 308, will go high. Second-quantity solo threshold decision block 318 and second-quantity solo timing block 320 are analogous to block 312 and block 314, respectively. The first-quantity threshold for combining decision block 322 and the second-quantity threshold for combining block 324 generally impose lower thresholds than do decision blocks 312 and 318, respectively. A two-input AND gate 326 receives the outputs of decision blocks 322 and 324 and goes high when both of their outputs are high. If the output of AND gate 328 remains high for the time period imposed by dual condition timer 328, then the output of OR gate 316 goes high.

The timeouts imposed by blocks 314, 320, and 328 may be of a null duration for some detection logic blocks. Typically, they would be short or nonexistent for instant detection logic blocks 234 and 244 (FIG. 8).

In one preferred embodiment, the first quantity is smoke concentration and the second quantity is rate of change of $CO_2$ concentration. The following table (Table 1) describes the thresholds and timeout periods for this embodiment.

TABLE 1

| Block from FIG. 8 | Block from FIG. 9 | Value |
|---|---|---|
| Tentative Flaming Fire Detection Logic 220 | X1 (Smoke Conc.) Solo Threshold 312 | >2% light obscuration per 0.3048 meter (1 foot) |
| Tentative Flaming Fire Detection Logic 220 | X1 (Smoke Conc.) Solo Timeout 314 | 10 seconds (2 samples) |
| Tentative Flaming Fire Detection Logic 220 | X1 (Smoke Conc.) Threshold for Combining 322 | >0.5% light obscuration per 0.3048 meter (1 foot) |
| Tentative Flaming Fire Detection Logic 220 | X2 ($CO_2$ rate) Threshold for Combining 324 | 100 ppm/min |

TABLE 1-continued

| Block from FIG. 8 | Block from FIG. 9 | Value |
|---|---|---|
| Tentative Flaming Fire Detection Logic 220 | Dual Condition Timeout 330 | 1 sample |
| Tentative Flaming Fire Detection Logic 220 | X2 ($CO_2$ rate) Solo Threshold 318 | 150 ppm/min |
| Tentative Flaming Fire Detection Logic 220 | X2 ($CO_2$ rate) Solo Timeout 320 | 10 seconds (2 samples) |
| Tentative Flaming Fire Detect. Bit Reset Logic 230 | X1 (Smoke Conc.) Solo Threshold 312 | <2% light obscuration per 0.3048 meter (1 foot) |
| Tentative Flaming Fire Detect. Bit Reset Logic 230 | X1 (Smoke Conc.) Solo Timeout 314 | 60 seconds (7 samples) |
| Tentative Flaming Fire Detect. Bit Reset Logic 230 | X1 (Smoke Conc.) Threshold for Combining 322 | <2.2% light obscuration per 0.3048 meter (1 foot) |
| Tentative Flaming Fire Detect. Bit Reset Logic 230 | X2 ($CO_2$ rate) Threshold for Combining 324 | <190 ppm/min |
| Tentative Flaming Fire Detect. Bit Reset Logic 230 | Dual Condition Timeout 330 | 30 seconds (4 samples) |
| Tentative Flaming Fire Detect. Bit Reset Logic 230 | X2 ($CO_2$ rate) Solo Threshold 318 | <150 ppm/min |
| Tentative Flaming Fire Detect. Bit Reset Logic 230 | X2 ($CO_2$ rate) Solo Timeout 320 | 60 seconds (7 samples) |
| Tentative Nonflaming Fire Detection Logic 231 | X1 (Smoke Conc.) Solo Threshold 312 | 1.5% per 0.3048 meter (1 foot) |
| Tentative Nonflaming Fire Detection Logic 231 | X1 (Smoke Conc.) Solo Timeout 314 | 0.0 seconds (Instantaneous) |
| Tentative Nonflaming Fire Detection Logic 231 | X1 (Smoke Conc.) Threshold for Combining | 1% per 0.3048 meter (1 foot) |
| Tentative Nonflaming Fire Detection Logic 231 | X2 ($CO_2$ rate) Threshold for Combining 324 | 100 ppm/min |
| Tentative Nonflaming Fire Detection Logic 231 | Dual Condition Timeout 330 | 0.0 seconds (Instantaneous) |
| Tentative Nonflaming Fire Detection Logic 231 | X2 ($CO_2$ rate) Solo Threshold 318 | N/A |
| Tentative Nonflaming Fire Detection Logic 231 | X2 ($CO_2$ rate) Solo Timeout 320 | N/A |
| Tentative Nonflaming Fire Detect. Bit Reset Logic 233 | X1 (Smoke Conc.) Solo Threshold 312 | 1.5% per 0.3048 meter (1 foot) |
| Tentative Nonflaming Fire Detect. Bit Reset Logic 233 | X1 (Smoke Conc.) Solo Timeout 314 | 60 seconds (7 samples) |
| Tentative Nonflaming Fire Detect. Bit Reset Logic 233 | X1 (Smoke Conc.) Threshold for Combining 322 | 1% per 0.3048 meter (1 foot) |
| Tentative Nonflaming Fire Detect. Bit Reset Logic 233 | X2 ($CO_2$ rate) Threshold for Combining 324 | 100 ppm/min |
| Tentative Nonflaming Fire Detect. Bit Reset Logic 233 | Dual Condition Timeout 330 | 60 seconds |
| Tentative Nonflaming Fire Detect. Bit Reset Logic 233 | X2 ($CO_2$ rate) Solo Threshold 312 | N/A |
| Tentative Nonflaming Fire Detect. Bit Reset Logic 233 | X2 ($CO_2$ rate) Solo Timeout 314 | N/A |
| Conclusive Flaming Fire Timed Detection Logic 240 | X1 (Smoke Conc.) Solo Threshold 312 | N/A |
| Timed Detection Logic 240 | X1 (Smoke Conc.) Solo Timeout 314 | N/A |
| Conclusive Flaming Fire Timed Detection Logic 240 | X1 (Smoke Conc.) Threshold for Combining 322 | 0.9% per 0.3048 meter (1 foot) |
| Conclusive Flaming Fire Timed Detection Logic 240 | X2 ($CO_2$ rate) Threshold for Combining 324 | 140 ppm/min |
| Conclusive Flaming Fire Timed Detection Logic 240 | Dual Condition Timeout 330 | 20 seconds (3 samples) |
| Conclusive Flaming Fire Timed Detection Logic 240 | X2 ($CO_2$ rate) Solo Threshold 318 | 800 ppm/min |
| Conclusive Flaming Fire Timed Detection Logic 240 | X2 ($CO_2$ rate) Solo Timeout 320 | 20 seconds (3 samples) |
| Conclusive Flaming Fire Instant Detection Logic 234 | X1 (Smoke Conc.) Solo Threshold 312 | N/A |
| Conclusive Flaming Fire Instant Detection Logic 234 | X1 (Smoke Conc.) Solo Timeout 314 | N/A |
| Conclusive Flaming Fire Instant Detection Logic 234 | X1 (Smoke Conc.) Threshold for Combining 322 | 1.0% per 0.3048 meter (1 foot) |
| Conclusive Flaming Fire Instant Detection Logic 234 | X2 ($CO_2$ rate) Threshold for Combining 324 | 150 ppm/min |
| Conclusive Flaming Fire Instant Detection Logic 234 | X1 ($CO_2$ rate) Solo Threshold 318 | 1,000 ppm |
| Conclusive Flaming Fire Instant Detection Logic 234 | X1 ($CO_2$ rate) Solo Timeout 320 | 1 sample |
| Conclusive Nonflaming Fire Timed Detection Logic 250 | X1 (Smoke Conc.) Solo Threshold 312 | 1.0% per 0.3048 meter (1 foot) |
| Conclusive Nonflaming Fire | X1 (Smoke Conc.) | 15 minutes |

TABLE 1-continued

| Block from FIG. 8 | Block from FIG. 9 | Value |
|---|---|---|
| Timed Detection Logic 250 | Solo Timeout 314 | |
| Conclusive Nonflaming Fire | X1 (Smoke Conc.) Threshold | 2.0% per 0.3048 meter |
| Timed Detection Logic 250 | for Combining 322 | (1 foot) |
| Conclusive Nonflaming Fire | X2 ($CO_2$ rate) | 120 ppm/min |
| Timed Detection Logic 250 | Threshold for Combining 324 | |
| Conclusive Nonflaming Fire | Dual Condition Timeout 330 | 3 minutes |
| Timed Detection Logic 250 | | |
| Conclusive Nonflaming Fire | X2 ($CO_2$ rate) | N/A |
| Timed Detection Logic 250 | Solo Threshold 318 | |
| Conclusive Nonflaming Fire | X2 ($CO_2$ rate) | N/A |
| Timed Detection Logic 250 | Solo Timeout 320 | |
| Conclusive Nonflaming Fire | X1 (Smoke Conc.) Solo | 3.0% per 0.3048 meter |
| Instant Detection Logic 244 | Threshold 312 | (1 foot) |
| Conclusive Nonflaming Fire | X1 (Smoke Conc.) | 2 minutes |
| Instant Detection Logic 244 | Solo Timeout 314 | |
| Conclusive Nonflaming Fire | X1 (Smoke Conc.) Threshold | 2.5% per 0.3048 meter |
| Instant Detection Logic 244 | for Combining 322 | (1 foot) |
| Conclusive Nonflaming Fire | X2 ($CO_2$ rate) | 140 ppm/min |
| Instant Detection Logic 244 | Threshold for Combining 324 | |
| Conclusive Nonflaming Fire | Dual Condition Timeout 330 | 1 sample |
| Instant Detection Logic 244 | | |
| Conclusive Nonflaming Fire | X2 ($CO_2$ rate) | N/A |
| Instant Detection Logic 244 | Solo Threshold 318 | |
| Conclusive Nonflaming Fire | X2 ($CO_2$ rate) | N/A |
| Instant Detection Logic 244 | SOlo Timeout 320 | |

In one preferred embodiment, the logic described above is implemented as a computer program in fire alarm control panel 640 or in microprocessor 29 (FIG. 4*a*). In an alternative preferred embodiment, the logic described above is implemented as a circuit with a set of discrete components. Either implementation is readily within the technical abilities of skilled persons.

Figure 10:
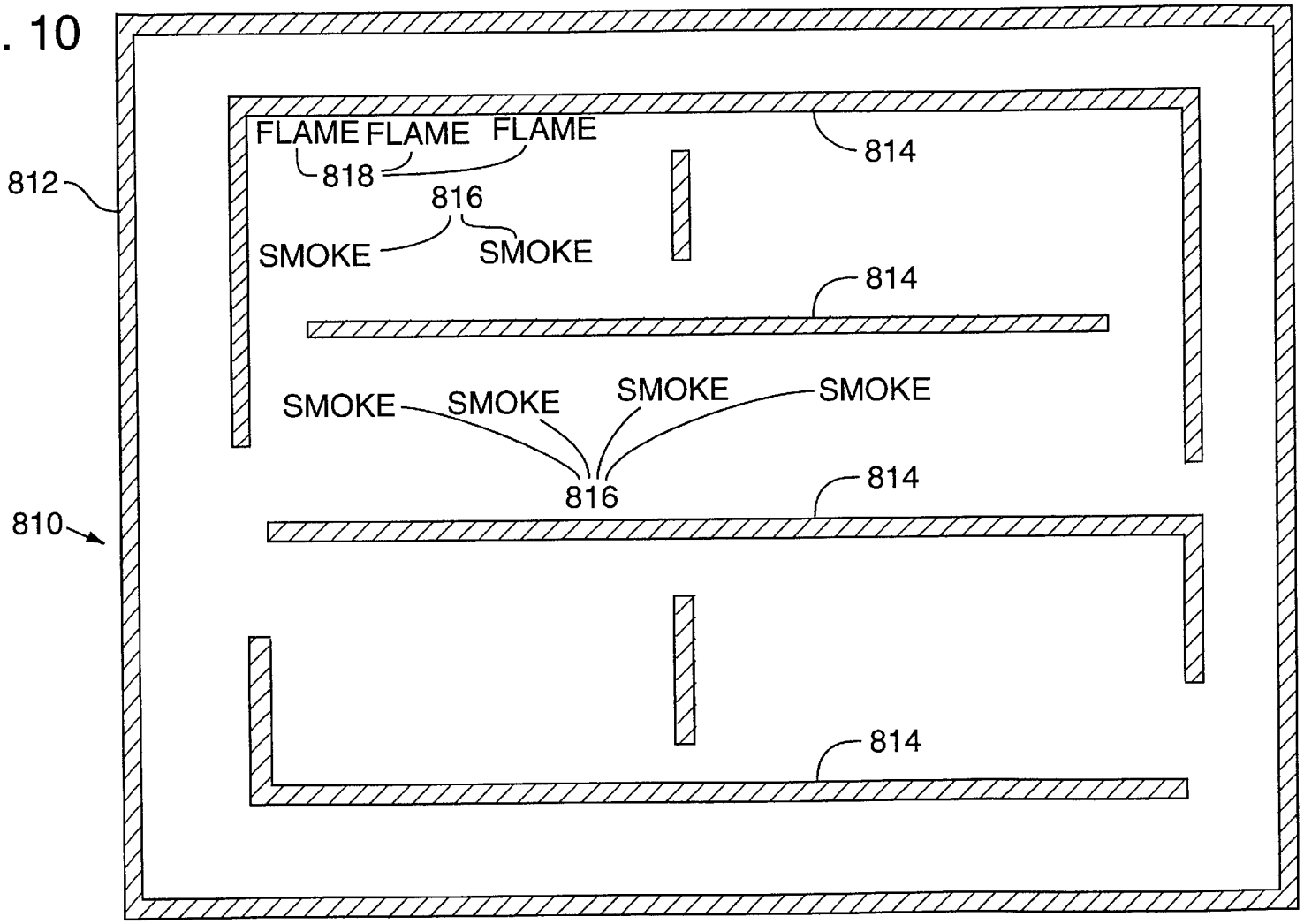
FIG. 10 is a map of fire and smoke locations, constructed in accordance with the present invention.

In addition, in a building having a fire alarm control panel that receives data from a network of sensors having two alarm signal types or that receives data from both $CO_2$ sensors and smoke sensors, the fire alarm control panel may be used to assemble a map 810 of fire and smoke locations, as shown in FIG. 10. Each sensor has an address or is otherwise identifiable to distinguish its location from the locations of the other sensors. Map 810 shows exterior walls 812, interior walls 814, locations having a high concentration of smoke 816, and locations in which the presence of a flaming fire is indicated 818. Such a map would prove invaluable to the safety of fire fighters arriving at the scene of the fire and to the effectiveness of their fire fighting efforts. These efforts frequently entail efforts to gain access to the flames to pour an antiflaming agent (typically water) onto them. A knowledge of the flame and smoke location and direction and extent of the spread of fire may permit guidance for the fire fighters to the least smoke-filled path to the flames.

Furthermore, in the instance in which a sensor is in an air conditioning duct, it is advantageous to distinguish between the case of a fire in the duct itself and a fire outside the duct. A duct fire is not so rare as the uninitiated might expect because the machinery that opens and closes the duct sometimes ignites. By sensing both $CO_2$ and smoke levels, the sensor can distinguish between the case where there are flames in the duct, which will cause a high rate of increase in $CO_2$ concentration, and the case where the fire is outside of the duct, which will cause a high level of smoke in the vent.

It will be readily apparent to skilled persons that further changes and modifications of the actual concepts described herein can readily be made without departing from the spirit and scope of the invention as defined by the following claims.

We claim:

1. In a fire detection system that includes a light reflection type smoke detector having a light emitter from which light propagates along a propagation path and a light sensor positioned at an angular offset relative to the propagation path, the light sensor receiving light emitted by the light emitter and reflected by smoke particles passing across the propagation path, and the angular offset being of greater measure for optimal detection of smoke particles produced by a flaming fire than that for optimal detection of smoke particles produced by a nonflaming fire, a method of providing a fire detection system that is capable of accurately detecting flaming and nonflaming fires in a spatial region, comprising:

fixing the angular offset of the light reflecting type smoke detector to a relatively small angle for detecting and producing a first signal representative of a smoke particle concentration produced by a nonflaming fire;

providing a carbon dioxide ($CO_2$) detector for detecting and producing a second signal representative of a $CO_2$ concentration produced by a flaming fire; and applying the first and second signals to processing circuitry that processes the first and second signals to determine whether either a flaming or a nonflaming fire condition is present in the spatial region and to produce an alarm signal in response to a determination of the presence of either condition.

2. The method of claim 1 in which the angular offset for optimal detection of smoke particles produced by a flaming fire is about 60° and the angular offset fixed is substantially less than 60°.

3. The method of claim 2 in which the angular offset fixed is about 30°.

4. The method of claim 1 in which the processing circuitry includes a microprocessor and the first and second signals are applied in digital form to the microprocessor.

5. The method of claim 1 in which processing circuitry calculates a rate of change of $CO_2$ concentration and generates the alarm signal whenever the processor circuitry calculates that the rate of change of $CO_2$ concentration exceeds a predetermined amount and after which within a predetermined time the first signal indicates a smoke particle concentration greater than a predetermined level.

6. The method of claim 5 in which the predetermined time exceeds 20 seconds.

7. The method of claim 5 in which the predetermined level of smoke particle concentration is between about 0.1% per foot and 4% per foot and the predetermined time does not exceed about 15 minutes.

8. The method of claim 5 in which in which the predetermined level of smoke particle concentration is between about 0.1% per foot and 4% per foot and the predetermined amount of rate of increase of $CO_2$ concentration is between about 30 ppm/min and 500 ppm/min.

9. A method of distinguishing aberrant light source operation from changes in smoke or $CO_2$ concentration levels measured by a fire detection system including a smoke detector and a $CO_2$ detector, comprising:

providing a smoke detector having a light detector that detects light within a first wavelength range to produce a first signal representative of smoke concentration in a spatial region;

providing a $CO_2$ detector having a light detector that detects light within a second wavelength range to produce a second signal representative of $CO_2$ concentration in the spatial region;

operatively associating with the smoke detector and the $CO_2$ detector a light source that emits light within an emission wavelength range encompassing at least a portion of each of the first and second wavelength ranges; and processing the first and second signals to detect the existence of aberrant light source operation by determining whether the first and second signals represent contemporaneous instances of mutual diminution of intensity of light incident on the smoke and $CO_2$ detectors.

10. The method of claim 9 in which the first wavelength range covers wavelengths of visible light and the second wavelength range covers wavelengths of infrared light.

11. The method of claim 9, further comprising providing an indication whenever the processing detects that light source failure is a cause of aberrant light source operation.

12. The method of claim 9 in which the processing includes adjusting the first and second signals in accordance with their ratio to mutually correct and thereby render them independent of variations in light source intensity.

13. A fire detection system having a prolonged operational lifetime, comprising:

a photoelectric smoke detector producing a first signal representing a measured concentration of smoke in a spatial region in which there is an actual concentration of smoke, the photoelectric smoke detector having an alarm threshold value representing a predetermined concentration of smoke;

correction circuitry that offsets the first signal by a drift tolerance amount to produce a corrected first signal that more accurately represents the actual concentration of smoke in the spatial region;

a $CO_2$ detector producing a second signal representing a concentration of $CO_2$ in the spatial region; and either one of the corrected first signal or the second signal causing production of an alarm signal whenever any member criterion of a predetermined set of criteria is satisfied, one member criterion in the predetermined set including a condition in which the corrected first signal exceeds the alarm threshold value for a predetermined time, the alarm threshold value and predetermined time being coordinated to cause no alarm signal production in response to actual concentrations of smoke that do not represent typical instances of anticipated sources of fire.

14. The fire detection system of claim 13 in which the correction circuitry offsets the first signal by no greater than a maximum drift tolerance amount and the alarm threshold value is much less than the maximum drift tolerance amount.

15. The fire detection system of claim 13 in which the ratio of the drift tolerance amount to the alarm threshold value is greater than 1.0.

16. The fire detection system of claim 13 in which the predetermined time is in the order of minutes to detect the presence of nonflaming fires.

17. The fire detection system of claim 13 in which a member criterion of the predetermined set includes a predetermined rate of change in concentration of $CO_2$ in the spatial region and in which production of the alarm signal occurs in response to the second signal representing the predetermined rate of change in $CO_2$ concentration.

18. A fire detection system that is capable of detecting flaming and nonflaming fires, comprising:

a smoke detector producing a first signal representing a smoke concentration in a spatial region; a $CO_2$ detector producing a second signal representing a rate of change of a concentration of $CO_2$ in the spatial region; and electrical circuitry producing an alarm signal in response to a result of a formulation to which the smoke concentration represented by the first signal and the rate of change of $CO_2$ concentration represented by the second signal contribute to characterize a fire condition existing in the spatial region.

19. A fire detection system of claim 18 in which the result is produced by a formulation that includes a level of smoke concentration and a rate of change of $CO_2$ concentration exceeding a predetermined threshold for a predetermined time.

20. The fire detection system of claim 18 in which a formulation including a combination of smoke concentration and rate of change of $CO_2$ concentration levels in coordination with a measurement time produces the result.

21. The fire detection system of claim 20 in which the combination and the measurement time counterbalance each other such that a larger or smaller combination value specifies, respectively, a shorter or a longer measurement time to produce the result.

22. The fire detection system of claim 18 in which the spatial region is the inside of an air duct of a structure and in which the first and second signals contributing to the characterization of a fire condition such that the smoke detector indicates the presence of fire outside the duct and the second signal indicates the presence of fire inside the duct.

23. The fire detection system of claim 18, in which the fire detection system is one of a set of nominally identical fire detection systems arranged in a network distributed in a structure, further comprising:

a central controller in data communication with the fire detection systems; and a processor determining the location of each fire detection system for providing a map indicating the location and extent of the spread of a fire in the structure.

24. A fire detection system comprising:

a light reflection type smoke detector having a light emitter from which light propagates along a propagation path and a light sensor positioned at an angular offset relative to the propagation path, the angular offset being fixed to a relatively small angle for detecting and producing a first signal representing a smoke concentration produced by a nonflaming fire in a spatial region;

a $CO_2$ detector producing a second signal representing a concentration of $CO_2$ in the spatial region;

electrical circuitry for receiving and retransmitting the first and second signals; and a fire alarm control panel communicatively coupled to the electrical circuitry for receiving the retransmitted first and second signals and producing an alarm signal whenever any member criterion of a predetermined set of criteria for the first and second signals is satisfied.

25. The fire detection system of claim 24 in which the smoke detector is physically separate from the $CO_2$ detector and in which the electrical circuitry is divided into physically separate first and second portions, the first portion receiving and transmitting the first signal and the second portion receiving and retransmitting the second signal.

26. The fire detection system of claim 24 in which the $CO_2$ detector includes a light source for emitting infrared light having a frequency in an absorption band of $CO_2$; a light detector adapted to receive the infrared light emitted by the light source; and an electrical circuit operatively associated with the light detector for computing the concentration of $CO_2$ and producing the second signal.

27. The fire detection system of claim 26 in which the light detector comprises a thermopile.

28. The fire detection system of claim 26 in which the light detector comprises a pyroelectric detector.

29. The fire detection system of claim 26 in which the thermopile is integrated with the electrical circuit to form a combination sensor/integrated circuit.

30. The fire detection system of claim 29 in which the smoke detector is a photoelectric smoke detector comprising a light emitting diode (LED) and a photodiode that receives light emitted by the LED to form the first signal, and in which the photodiode is integrated into the combination sensor/integrated circuit.

31. The fire sensing system of claim 24 in which the fire alarm control panel receives signals from a multiplicity of $CO_2$ detectors and smoke detectors installed at specific locations within a building.

32. The fire sensing system of claim 31 in which the fire alarm control panel includes circuitry for identifying the locations of the $CO_2$ and smoke detectors and for generating a map of smoke and fire locations within the building.

33. The fire sensing system of claim 31 in which the second signal is correlated with a member criterion corresponding to the presence of flames.

34. The fire sensing system of claim 31 in which the first signal is correlated with a member criterion corresponding to the presence of smoke.

* * * * *